US012514319B2

(12) United States Patent
Bologna et al.

(10) Patent No.: US 12,514,319 B2
(45) **Date of Patent: *Jan. 6, 2026**

(54) AMERICAN FOOTBALL HELMET

(71) Applicant: Riddell, Inc., Des Plaines, IL (US)

(72) Inventors: Vittorio Bologna, Elk Grove, IL (US); Nelson Kraemer, Mount Prospect, IL (US); Ralph Infusino, Bloomingdale, IL (US); Thad M. Ide, Chicago, IL (US)

(73) Assignee: Riddell, Inc., Des Plaines, IL (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/731,448

(22) Filed: Jun. 3, 2024

(65) Prior Publication Data

US 2024/0315378 A1 Sep. 26, 2024

Related U.S. Application Data

(63) Continuation of application No. 17/990,262, filed on Nov. 18, 2022, which is a continuation of application No. 17/728,226, filed on Apr. 25, 2022, now Pat. No. 11,503,872, which is a continuation of application No. 17/135,099, filed on Dec. 28, 2020, now Pat. No. 11,311,067, which is a continuation of application (Continued)

(51) Int. Cl.
*A42B 3/12* (2006.01)

(52) U.S. Cl.
CPC ..... *A42B 3/127* (2013.01); *A42B 3/122* (2013.01); *A42B 3/125* (2013.01); *A42B 3/128* (2013.01)

(58) Field of Classification Search
CPC .... A42B 3/00; A42B 3/10; A42B 3/12; A42B 3/121; A42B 3/122; A42B 3/125; A42B 3/27; A42B 3/128

(Continued)

(56) References Cited

U.S. PATENT DOCUMENTS 3,882,547 A * 5/1975 Morgan ..... A42B 3/121 267/117
4,023,213 A * 5/1977 Rovani ..... A42B 3/121 2/909

(Continued)

FOREIGN PATENT DOCUMENTS

KR 20060089967 A * 8/2006 ..... A42B 3/125

OTHER PUBLICATIONS

English machine translation of KR-20060089967-A. Via Clarivate Analytics performed on PE2E Search. Translation performed on Jan. 22, 2025. (Year: 2006).*

*Primary Examiner* — Jameson D Collier
(74) *Attorney, Agent, or Firm* — Barnes & Thornburg LLP

(57) ABSTRACT

An American football helmet including a crown energy attenuation assembly positioned within a crown region of the helmet shell. The crown energy attenuation assembly includes: a first energy attenuation element with a plurality of sidewalls arranged to form a hexagonal housing, wherein a first sidewall has a substantially planar configuration; a second energy attenuation element with a plurality of sidewalls arranged to form a hexagonal housing, wherein a first sidewall has a substantially planar configuration; and, a third energy attenuation element with a plurality of sidewalls that are arranged to form a hexagonal housing. A first crown gap is formed between the first and second energy attenuation elements. A second crown gap is formed between the second and third energy attenuation elements. A third crown gap is formed between an extent of the third and first energy attenuation elements. The crown energy attenuation assembly further includes a layer positioned adjacent to the plurality of sidewalls of the energy attenuation elements.

35 Claims, 18 Drawing Sheets

Related U.S. Application Data

No. 15/705,984, filed on Sep. 15, 2017, now Pat. No. 10,874,162, which is a continuation of application No. 13/229,165, filed on Sep. 9, 2011, now Pat. No. 9,763,488.

(58) Field of Classification Search
USPC ..... 2/410–414
See application file for complete search history.

(56) References Cited

U.S. PATENT DOCUMENTS

| | | | | | |
|---|---|---|---|---|---|
| 5,014,365 | A * | 5/1991 | Schulz | A42B 3/122 | 2/909 |
| 5,175,889 | A * | 1/1993 | Infusino | A42B 3/122 | 2/413 |
| 5,915,819 | A * | 6/1999 | Gooding | A43B 19/00 | 36/71 |
| 6,934,971 | B2 * | 8/2005 | Ide | A42B 3/08 | 2/9 |
| 9,289,024 | B2 * | 3/2016 | Withnall | A42B 3/08 | |
| 9,763,488 | B2 * | 9/2017 | Bologna | A42B 3/122 | |
| 10,874,162 | B2 * | 12/2020 | Bologna | A42B 3/125 | |
| 11,311,067 | B2 * | 4/2022 | Bologna | A42B 3/125 | |
| 11,503,872 | B2 * | 11/2022 | Bologna | A42B 3/127 | |
| 2011/0271428 | A1 * | 11/2011 | Withnall | A42B 3/20 | 2/422 |
| 2022/0240617 | A1 * | 8/2022 | Bologna | A42B 3/125 | |
| 2023/0085369 | A1 * | 3/2023 | Bologna | A42B 3/127 | 2/414 |

* cited by examiner

FIG. 3
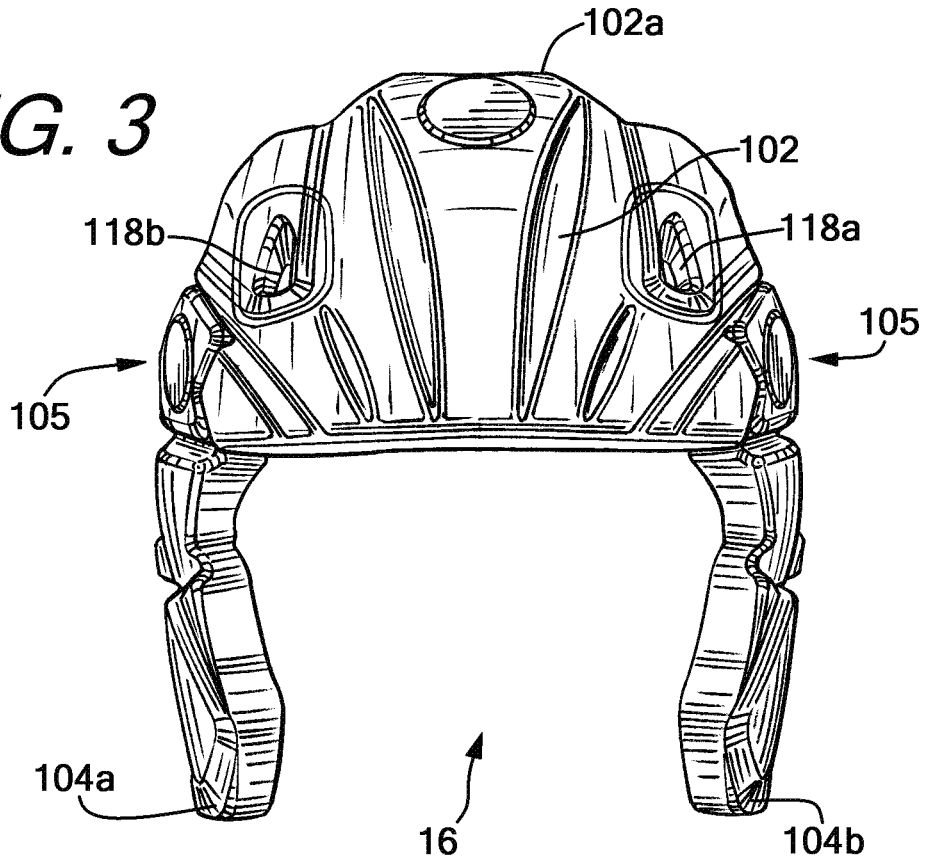
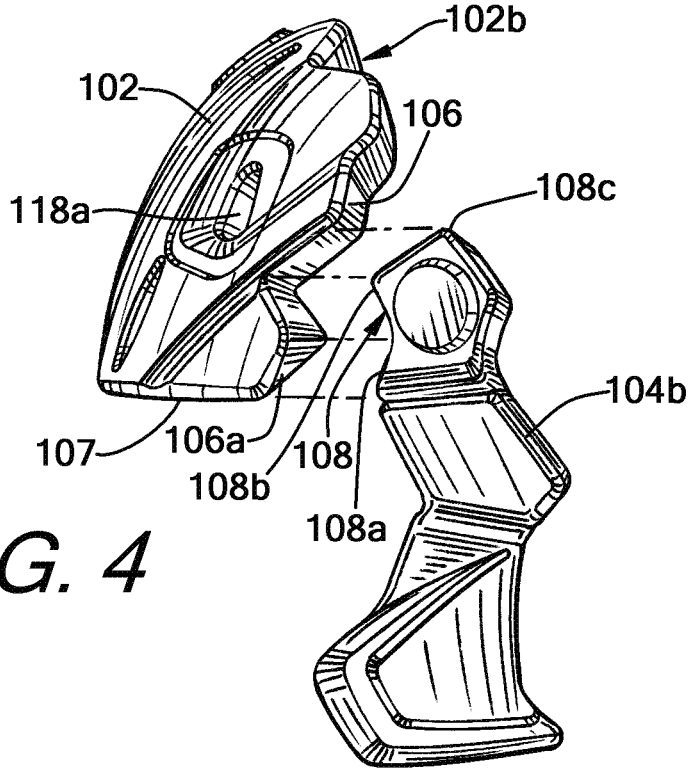
FIG. 4

FIG. 7
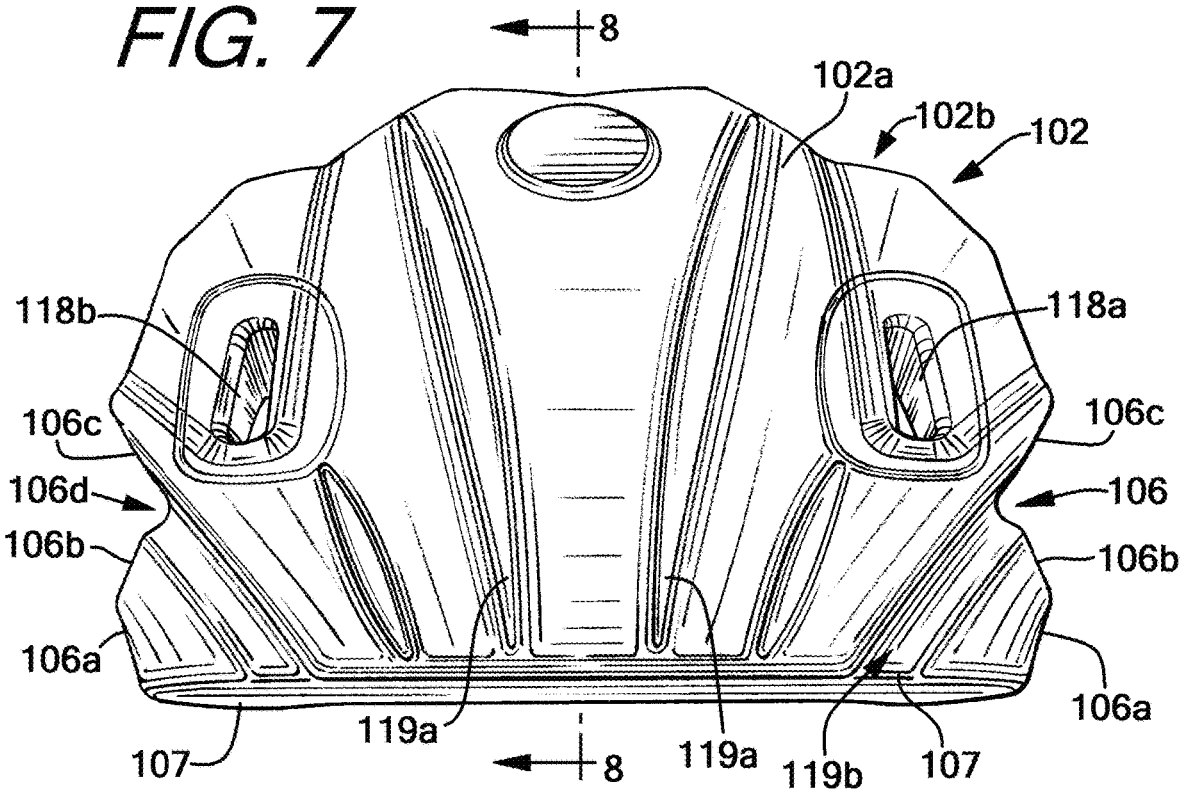
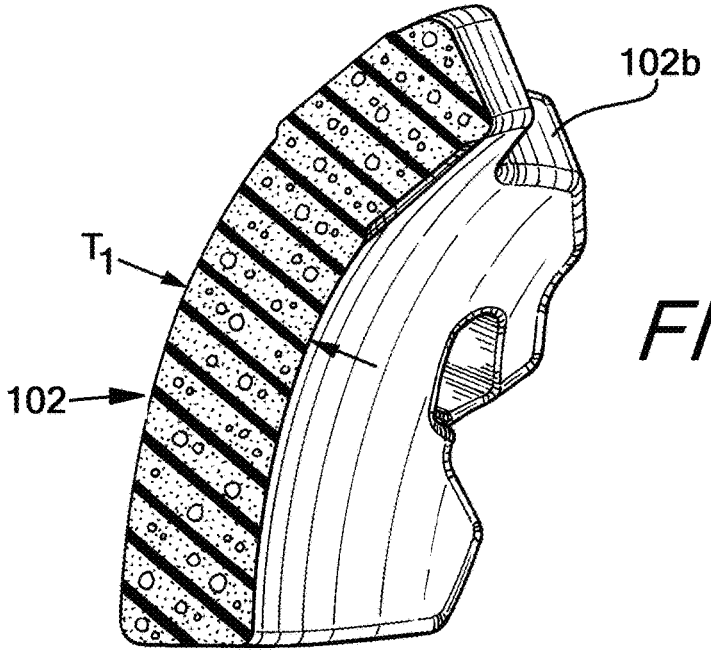
FIG. 8

AMERICAN FOOTBALL HELMET

CROSS-REFERENCE TO RELATED APPLICATIONS

This application is a continuation of pending U.S. patent application Ser. No. 17/990,262, which is a continuation of U.S. Pat. No. 11,503,872, which is a continuation of U.S. Pat. No. 11,311,067, which is a continuation of U.S. Pat. No. 10,874,162, which is a continuation of U.S. Pat. No. 9,763,488, the disclosures of which are hereby incorporated by reference in their entirety for all purposes.

TECHNICAL FIELD

The invention generally relates to a protective sports helmet, such as a football, lacrosse, hockey or baseball helmet, worn by a player during the play of a contact sport. The inventive helmet includes a number of improvements, including but not limited to a unique internal padding assembly that dissipates impact forces received by the helmet.

BACKGROUND OF THE INVENTION

Helmets for contact sports, such as those used in football, hockey and lacrosse, typically include a shell, an internal padding assembly, a faceguard or face mask, and a chin protector or strap that removably secures the helmet on the wearer's head. The internal padding assembly is secured to an interior surface of the shell to absorb a portion of energy received from a force applied to an exterior surface of the shell. Existing padding assemblies often include a plurality of padding elements that are arranged to contact a wearer's head when the helmet is worn.

Existing internal padding assemblies that are affixed to the inner surface of a football helmet often include a number of pad elements that may be formed from absorbent foam, air, gel or a combination thereof. Air may be utilized as an inflation fluid to adjust the dimensions of the pad element. An example of such a pad element is disclosed in U.S. Pat. No. 5,175,889. Another example of a helmet with an inflatable bladder is shown in U.S. Pat. No. 5,014,365. Conventional padding assemblies do not fully accommodate the anatomical distinctions among various wearer's heads, and under certain helmet impact conditions, these padding assemblies may not prevent the helmet from rotating about the wearer's head. This rotation may occur under a variety of conditions, including when the helmet's facemask is pulled, or when a player and/or helmet is subjected to a severe impact or a number of nearly simultaneous impacts.

The present invention is provided to solve these limitations and to provide advantages and aspects not provided by conventional sports helmets. A full discussion of the features and advantages of the present invention is deferred to the following detailed description, which proceeds with reference to the accompanying drawings.

SUMMARY OF THE INVENTION

The present invention is directed to a protective sports helmet that includes a number of improvements intended to increase the protective attributes of the helmet. For example, the helmet features an energy attenuating internal padding system with a face frame padding assembly comprising a brow pad and a pair of jaw pads that are cooperatively dimensioned and positioned within the helmet to frame the face of the wearer. The padding assembly also includes a unique crown pad element with an internal separation layer that partitions the pad element into a first inflatable section and a second un-inflatable section, which increases the stability of the helmet on the wearer's head. Additionally, the padding system assembly includes an occipital locking pad that contacts the occipital portion of the wearer's skull to resist forward and/or rearward rotation of the helmet when an impact(s) is applied to the helmet during the course of play of the contact sport.

While it is desirable that a protective sports helmet prevents injuries from occurring, it should be noted that due to the nature of contact sports (including football), no sports helmet, including the helmet of the present invention, can completely prevent injuries to those individuals playing sports. It should be further noted that no protective equipment can completely prevent injuries to a player, especially when the player uses the equipment improperly and/or employs poor form or technique. For example, if a football player uses the helmet in an improper manner, such as to butt, ram, or spear an opposing player (which is in violation of the rules of football), this can result in severe head and/or neck injuries, paralysis, or death to the football player, as well as possible injury to the football player's opponent. No football helmet, or protective helmet (such as that of the present invention) can prevent head, chin, or neck injuries a football player might receive while participating in the sport of football. The helmet of the present invention is believed to offer protection to football players, but it is believed that no helmet can, or will ever, totally and completely prevent injuries to football players.

Other features and advantages of the invention will be apparent from the following specification taken in conjunction with the following drawings.

BRIEF DESCRIPTION OF THE DRAWINGS

To understand the present invention, it will now be described by way of example, with reference to the accompanying drawings in which:

FIG. 3 is a front view of a face frame padding assembly of the invention;

FIG. 4 is an exploded side view of the face frame padding assembly;

FIG. 7 is a front view of a brow pad of the face frame padding assembly;

FIG. 8 is a sectional view of the brow pad taken through line 8-8 of FIG. 7;

Figure 1:
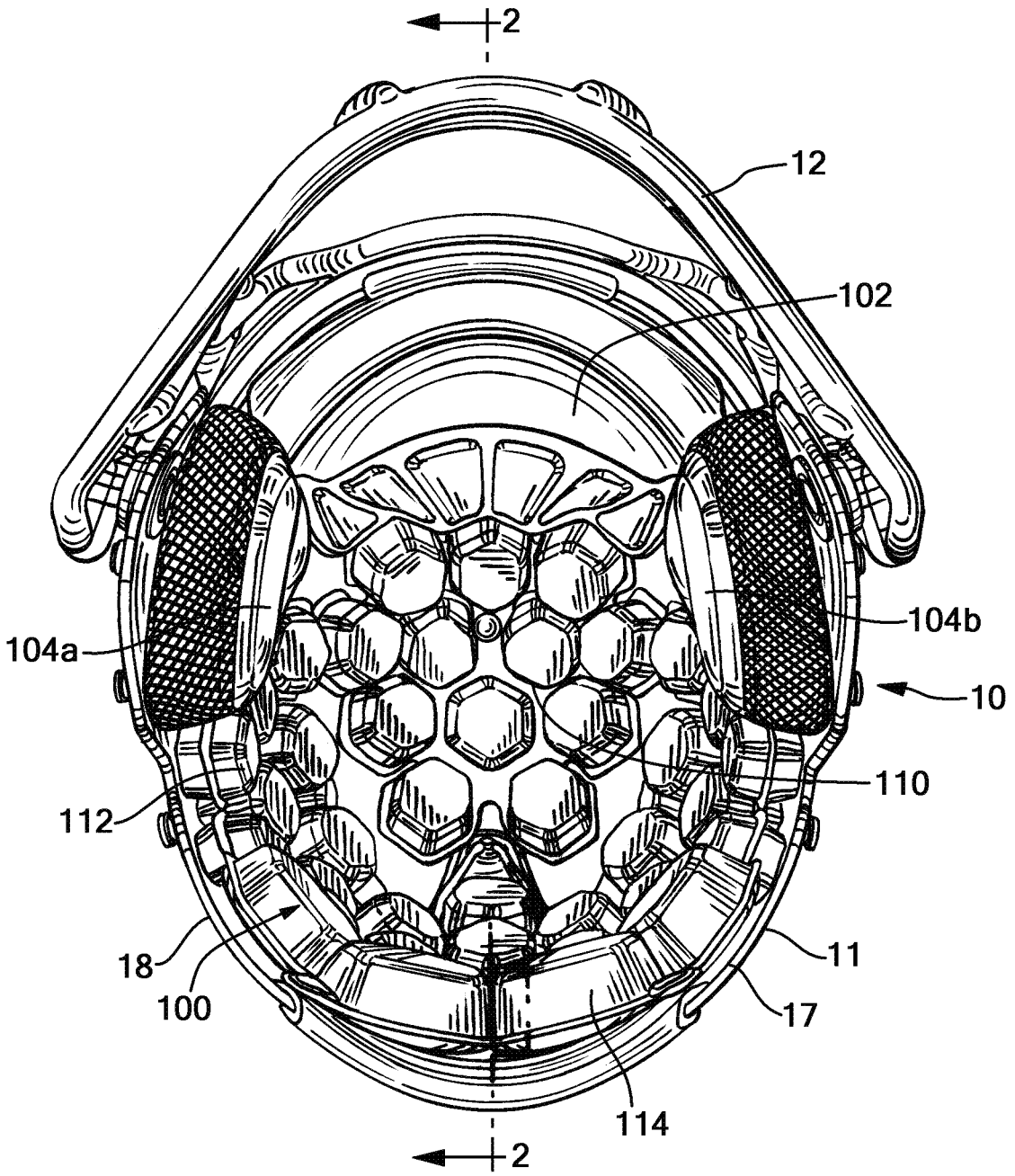
FIG. 1 is a bottom view of an embodiment of an inventive sports helmet with internal padding assembly.

While the invention will be described in connection with the preferred embodiments shown herein, it will be understood that it is not intended to limit the invention to those embodiments. On the contrary, it is intended to cover all alternatives, modifications, and equivalents, as may be included within the spirit and scope of the invention as defined by the appended claims.

DETAILED DESCRIPTION

While this invention is susceptible of embodiments in many different forms, there is shown in the drawings and will herein be described in detail preferred embodiments of the invention with the understanding that the present disclosure is to be considered as an exemplification of the principles of the invention and is not intended to limit the broad aspect of the invention to the embodiments illustrated.

Figure 2A:
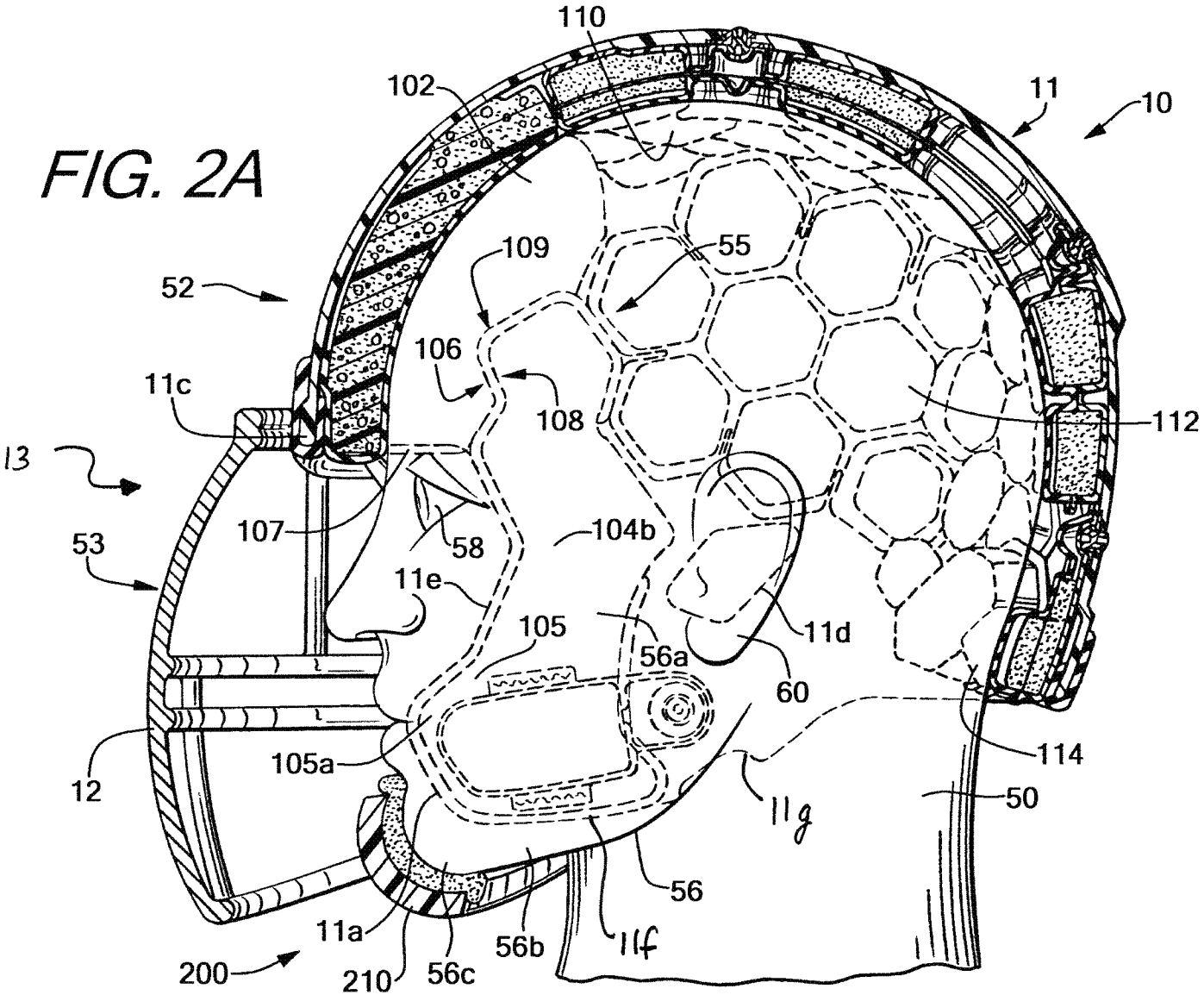
FIG. 2A is a sectional view taken through line 2-2 of the helmet of FIG. 1, including a wearer of the helmet being partially shown and padding elements of the padding assembly being shown in phantom lines.
Figure 2B:
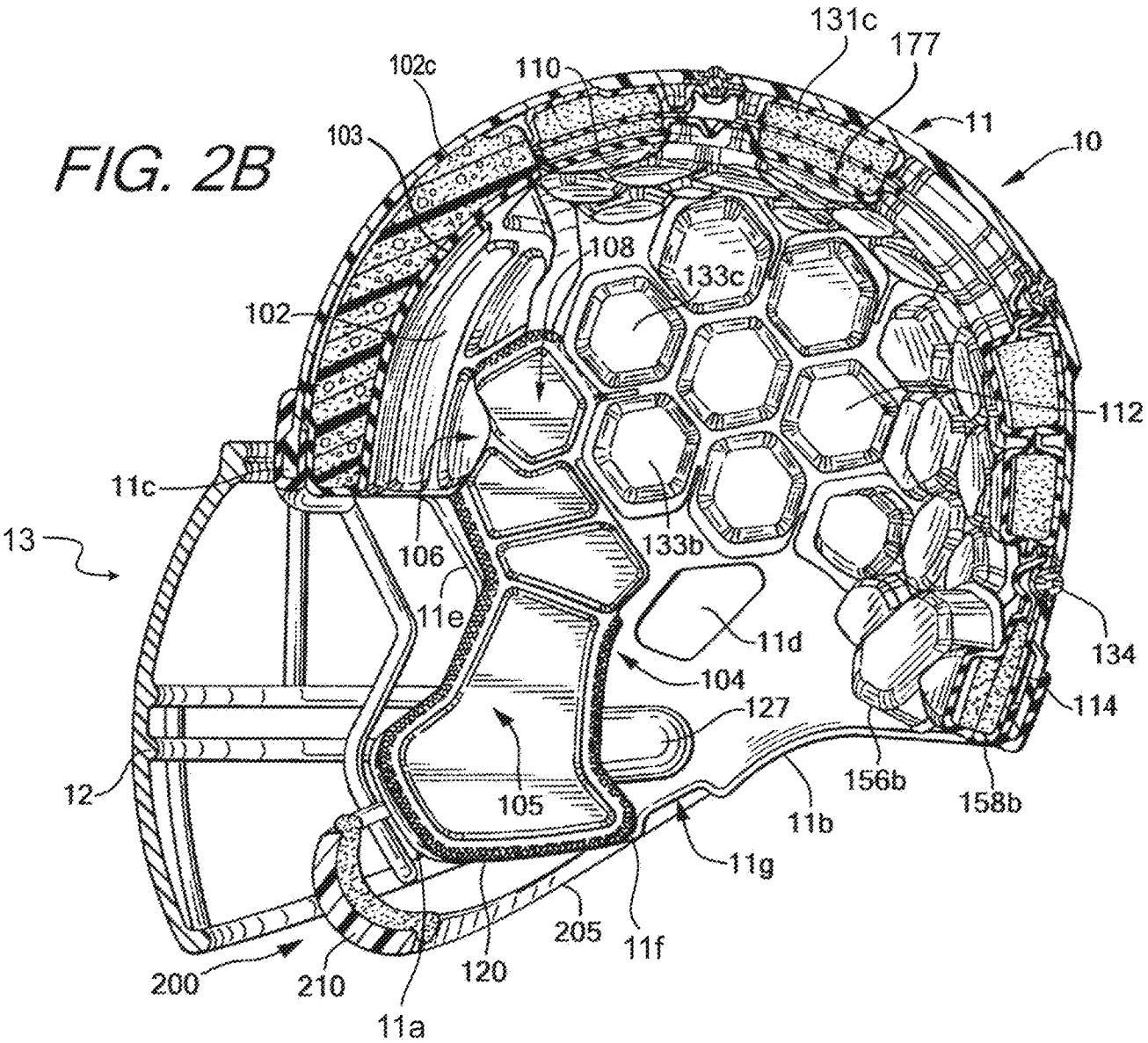
FIG. 2B is a sectional view taken through line 2-2 of the helmet of FIG. 1, including padding elements of the padding assembly being shown in phantom lines.
Figure 5:
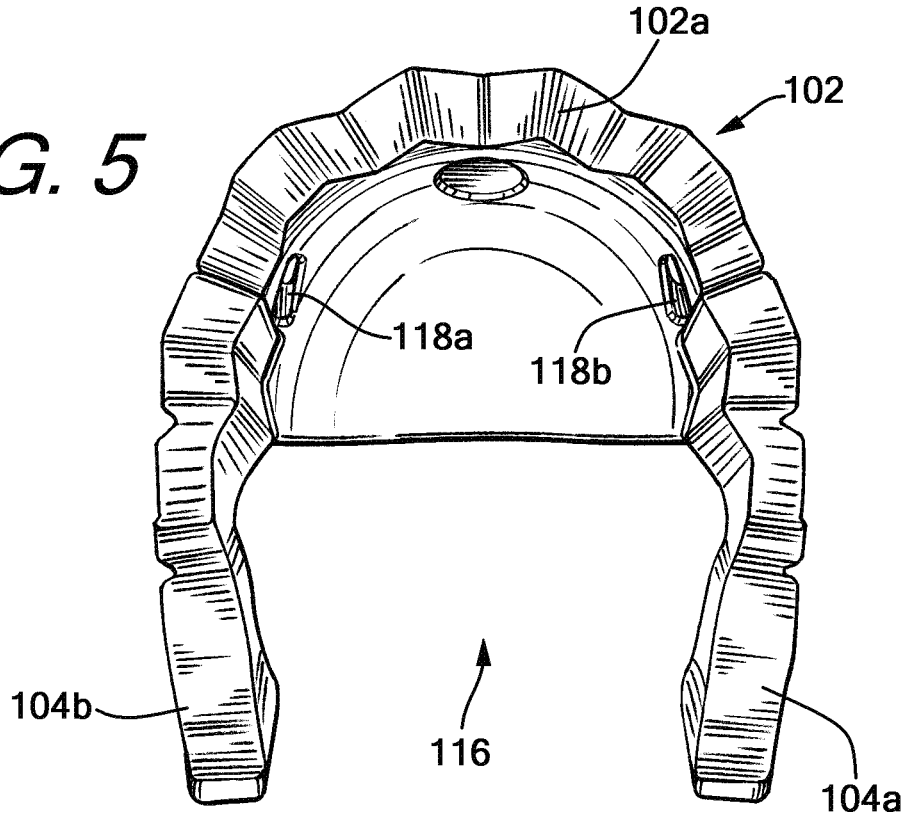
FIG. 5 is a rear view of the face frame padding assembly.

In the Figures, a football helmet 10 in accordance with the present invention is shown and that includes: an outer shell 11, a faceguard 12, and an internal padding system 100. The helmet 10, the shell 11, and the faceguard 12 are substantially similar to those disclosed in U.S. patent application Ser. No. 13/068,104 filed on May 2, 2011 which is incorporated by reference herein in its entirety. The outer shell 11 is preferably made of any suitable plastic material having the requisite strength and durability characteristics to function as a football helmet, or other type of protective helmet, such as polycarbonate plastic materials, one of which is known as LEXAN®, as is known in the art. In the connected position shown in FIGS. 1-3, the faceguard 12 is positioned adjacent to a portion of an outer surface 18 of the shell 11. Referring to FIGS. 2A and B, the faceguard 12 covers a frontal opening 13 of the shell 11 that exposes the wearer's face 53, wherein the periphery of the frontal opening 13 is defined by a frontal jaw flap edge 11*a*, a front shell edge 11*c* and a lateral shell edge 11*e* that extends between the frontal jaw flap edge 11*a* and the front shell edge 11*c*. The frontal jaw flap edge 11*a* extends upward from a lower jaw flap edge 11*f* that is substantially linear. As shown in FIG. 2B, a rear lower edge 11*b* of the shell 11 extends between opposed lower jaw flap edges 11*f*, and includes a notch 11*g* that receives an extent of a strap member 205 of a chin protector assembly 200 when the helmet 10 is secured on the wearer's head 51. As shown in FIG. 2A, the chin protector assembly 200 includes a curvilinear cup member 210 that engages the wearer's chin 56*c*.

The Figures show an internal padding system 100 which is connected to an inner surface (or wall) 17 of the helmet 10. Preferably, the internal padding system 100 is releasably connected to the inner wall surface 17 by a plurality of connector means. Preferably the connectors means includes a hook and loop fastener assembly 136, which is generally referred to as a VELCRO® attachment, as by placing the hook and loop assembly on the internal padding system assembly 100 and the inner shell surface 17. The internal padding system 100 includes a face frame pad assembly 101 comprising a brow pad 102, a first jaw pad 104*a*, and a second jaw pad 104*b* that collectively define a frontal pad opening 16 (see FIG. 3). As shown in FIGS. 2A and 2B, the brow pad 102 resides within a partial liner 103 that leaves an upper, inner extent 102*c* of the brow pad 102 exposed and in direct contact with the inner surface of the shell 11. The internal padding system 100 further includes a crown pad assembly 110, a side pad assembly 112, and an occipital cradle pad assembly 114. In general, a pad assembly, such as the crown pad assembly 110, comprises a plurality of pad elements, wherein each pad element includes at least one pad member comprised of a pad material. As discussed below, two pad members can be combined to form a single pad element.

When the helmet 10 is worn, the brow pad 102 mates with the jaw pads 104 to enable the face frame pad assembly 101 to engage the frontal portion 52 of the wearer's head 51 while framing the wearer's face 53. The frontal head portion 52 includes the wearer's forehead 54 and the side regions depending downward there from to both sides of the wearer's jaw 56. Due to the mating of these components, the face frame pad assembly 101 provides continuous, interacting padding engagement between both of the wearer's jaws and across the forehead 54 (see FIGS. 2 and 3), meaning without an appreciable gap, interruption or discontinuity among the brow pad 102 and the jaw pads 104. In existing protective sports helmets with conventional internal padding assemblies, there is an appreciable gap, interruption or discontinuity because the brow pad and the jaw pads are separated by a considerable distance (e.g., at least 0.25 inch) that precludes continuous, interacting padding engagement. The brow pad 102 is configured to be positioned adjacent the wearer's brow and forehead 54, while the first and second jaw pads 104*a, b* are configured to be positioned adjacent the jaw 56 of the wearer 50. The brow pad 102 extends across the forehead 54 of the wearer 50, and between the temples 55 of the wearer 50. The first and second jaw pads 104*a, b* are substantially symmetric, wherein the first jaw pad 104*a* engages the right side of the wearer's jaw 56 and the second jaw pad 104*b* engages the left side of the wearer's jaw 56. The mating between the brow pad 102 and the jaw pad 104 provides an interconnection point 109 of the face frame assembly 101, wherein the interconnection point 109 is positioned above the front shell edge 11*c*, the shell ear opening 11*d*, and the wearer's eye 58 and ear 60 (see FIG.

Figure 14:
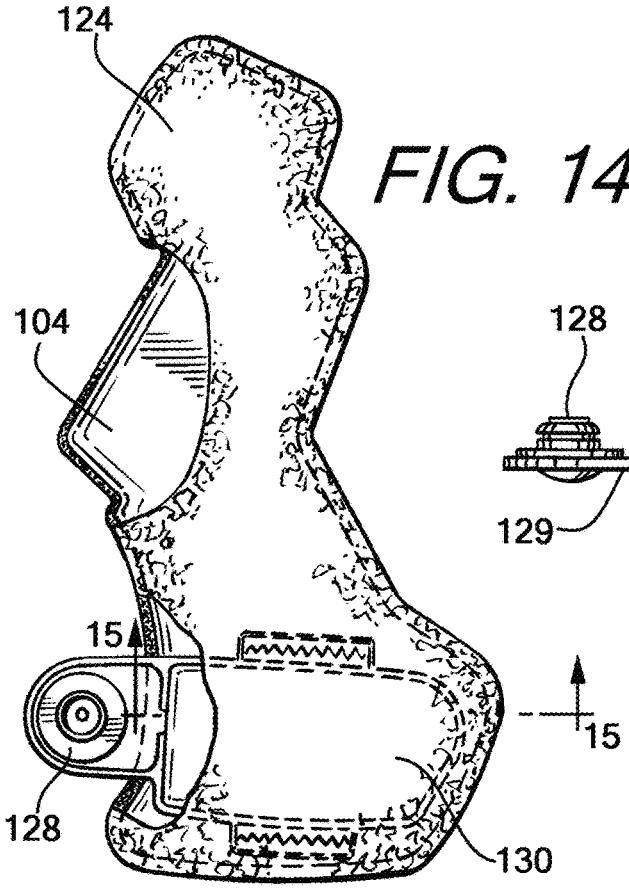
FIG. 14 is a second side view of the jaw pad of the face frame padding assembly positioned within a padding liner.
Figure 15:
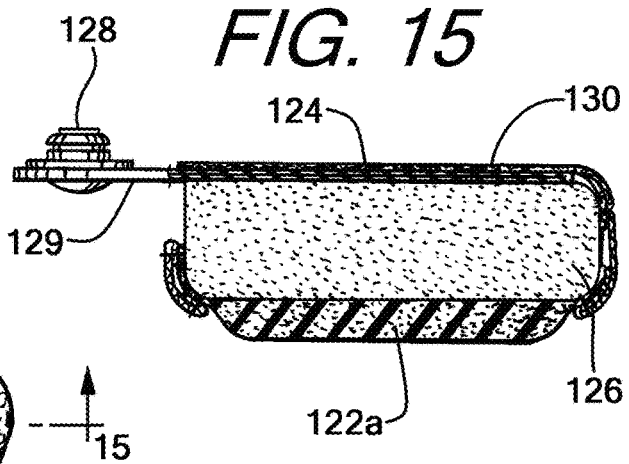
FIG. 15 is a sectional view taken through line 15-15 of FIG. 14.

2). The interconnection point 109 is preferably above a horizontal chord that is aligned with the front shell edge 11*c* and extends laterally there from to divide the shell 11 into upper and lower halves. The jaw pad 104 extends upward from the wearer's jaw 56, past the front shell edge 11*c*, the shell ear opening 11*d* and the wearer's eye 58 and ear 60, to the interconnection point 109 proximate the wearer's temple 55. Preferably, the interconnection point 109 is rearward or aft of the outer corner of the wearer's eye 58 (see FIG. 2). The interconnection between the brow pad 102 and the jaw pad 104 of the inventive helmet 10 differs significantly from the internal padding assemblies taught by the prior art. For example, U.S. Pat. No. 6,934,971 discloses a side pad assembly 125 with a sling 160 having an opening 161 that physically receives an upper pad member 151 of the jaw pad assembly 135 that is inserted into and through the opening 161 (see FIGS. 14 and 15). The '971 patent teaches that the insertion through the opening 161 is required to allow the pad member 151 to be suspended from the sling 160. In contrast, neither the brow pad 102 nor the jaw pad 104 are inserted through the other pad to form the interconnection point 109. Further, the '971 patent lacks any disclosure concerning the face frame pad assembly 101, including the mating between the brow pad 102 and the jaw pad 104 that leads to interconnection, the location of said interconnection, or the structures of the brow pad 102 and the jaw pad 104 that allow for interconnection.

The lower and intermediate portions of the jaw pad 104 overlie the ramus portion 56*a* of the wearer's jaw 56, wherein the lower portion 105 has a forwardly extending segment 105*a* that overlies a significant extent of the body portion 56*b* of the wearer's jaw 56. When the helmet 10 is worn, the jaw pads 104*a, b* expose, and do not overlie, the mental protuberance or chin 56*c* of the wearer's jaw 56. The lower jaw pad portion 105 has a substantially linear lower edge 105*b*, substantially linear front edge 105*c* extending upward from the lower edge 105*b*, and an upper edge 105*d* that is inclined from the front edge 105*c*. The front edge 105*c* and the lower edge 105*b* are set back from the frontal jaw flap edge 11*a* of the shell 11, thereby exposing an inner surface of the shell 11 in that region. The lower jaw pad portion 105 also has a curvilinear rear edge 105*e* that defines a recess 105*f*. In addition to the recess 105*f*, an upper portion of the rear jaw pad 105*g* has a series of angled edges, including a rear projection 105*h* that is positioned slightly above a midpoint of the overall height of the jaw pad 104 and that is aligned with the shell ear opening 11*d*, including an upper edge of the ear opening 11*d*. The rear projection 105*h* is slightly rearward of a lowermost projection 105*i* located between the lower edge 105*b* and the recess 105*f*.

Figure 6:
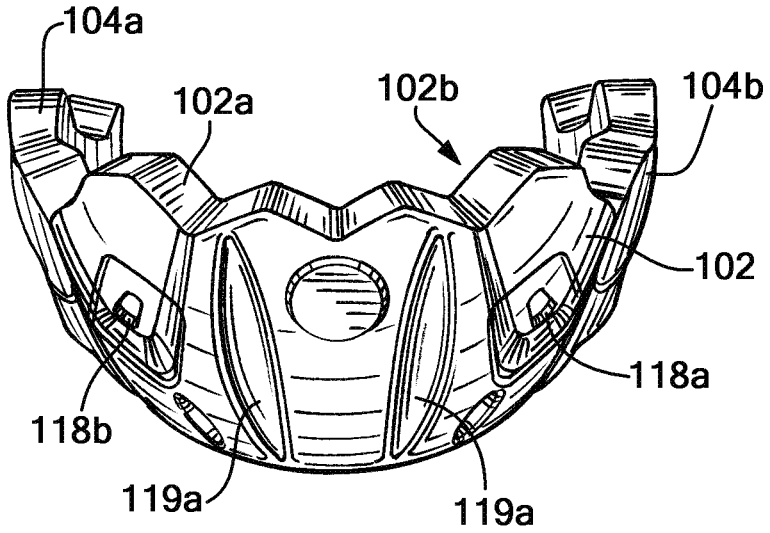
FIG. 6 is a top view of the face frame padding assembly.
Figure 9:
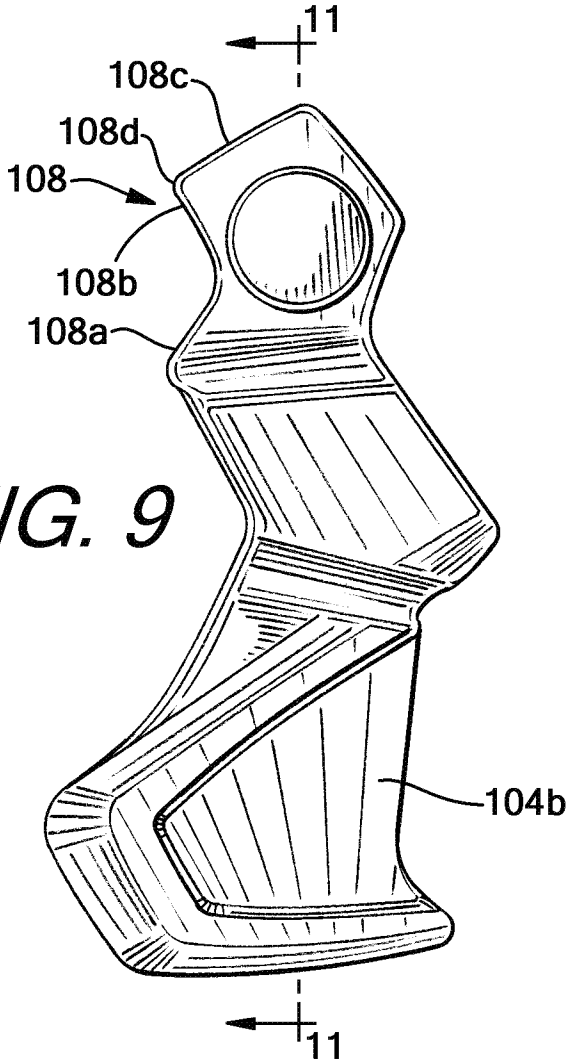
FIG. 9 is a side view of a jaw pad of the face frame padding assembly.

As shown in FIGS. 2-15, the brow pad 102 and the jaw pad 104 have means for interconnecting to facilitate mating at the interconnection point 109. This mating at the interconnection point 109 provides continuous, interacting padding engagement between both of the wearer's jaw 56 and across the forehead 54, thereby preventing an appreciable interruption or discontinuity between the brow pad 102 and the jaw pads 104. In one embodiment, the interconnection means includes the brow pad 102 with peripheral connection portions 106 that are cooperatively dimensioned and positioned to interlock with connection portions 108 of the jaw pads 104*a, b*. Unlike conventional helmet padding assemblies that include pad elements that are adjacent or adjoining, the brow pad 102 and the jaw pad 104 feature specific structures that enables the interconnection discussed below. Preferably, the brow pad connection portion 106 is located along a lower, peripheral portion of the brow pad 102, and the jaw pad connection portion 108 is located along an upper portion of the jaw pad 104. Referring to FIGS. 2, 4 and 7, the brow pad's connection portion 106 includes a first connection segment 106*a* that extends substantially rearward and upward from a lower edge 107 of the brow pad 102. A second segment 106*b* extends substantially forward and upward from the first segment 106*a* of the connection portion 106. A third segment 106*c* extends substantially rearward and upward from the second segment 106*b* of the connection portion. The first, second and third segments 106*a-c* define an arrangement of projections and at least one recess 106*d* on each periphery of the brow pad 102 (see FIG. 7). The rear edge 102*a* of the brow pad 102 extends between the opposed connections portion 106, and defines a plurality of teeth 102*b* (see FIGS. 2 and 6) that intermesh with the leading edge portion of the crown pad 110. Referring to FIGS. 2, 4 and 9, the connection portion 108 of the jaw pad 104 includes a first connection segment 108*a* that extends substantially rearward and upward from a point on the jaw pad 104*b* that is substantially proximate the bottom edge 107 of the brow pad 102. A second segment 108*b* extends substantially forward and upward from the first segment 108*a* of the connection portion 108. A third segment 108*c* extends substantially rearward and upward from the second segment 108*b* of the connection portion 108. The first, second and third segments 108*a-c* define at least one front projection 108*d* (see FIG. 9) that is received by the recess 106*d* of the brow pad connection portion 106 in the assembled position of FIG. 2.

In an assembled position of FIGS. 2 and 3, the connection portions 106, 108 intermesh at the interconnection point 109 to facilitate engagement between the brow pad 102 and the jaw pad 104. Further, the first segment 106*a* of the brow pad 102 is disposed proximate and abuts the first segment 108*a* of the jaw pad 104*b*. In the assembled position, the lowermost point of the connection segment 108*a* is preferably adjacent the brow pad lower edge 107 and above the wearer's eye 58. The second segment 106*b* of the brow pad 102 is disposed proximate and abuts the second segment 108*b* of the jaw pad 104*b*. Likewise, the third segment 106*c* of the brow pad 102 is disposed proximate and abuts the third segment 108*c* of the jaw pad 104*b*. The interaction of the connection portion 106 of the brow pad 102 and the connection portion 108 of the jaw pads 104*a*, 104*b* limit movement there between and thereby maintain positioning between the brow pad 102 and the jaw pads 104*a*, 104*b* for the face frame assembly 101, as well as the face frame assembly 101 relative to the wearer 50.

Figure 11:
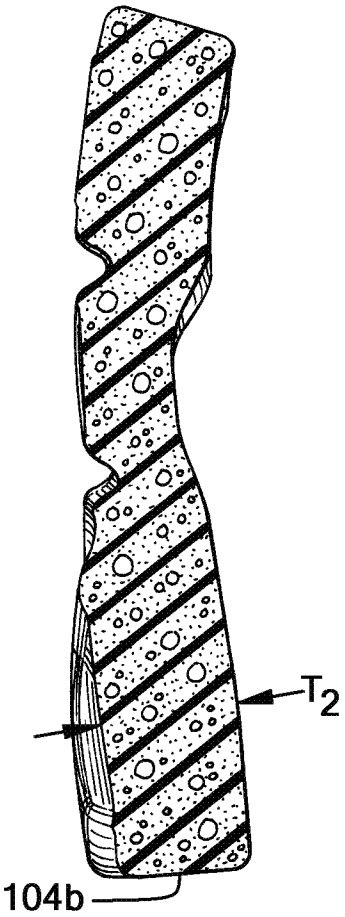
FIG. 11 is a sectional view of the jaw pad taken through line 11-11 of FIG. 9.
Figure 10:
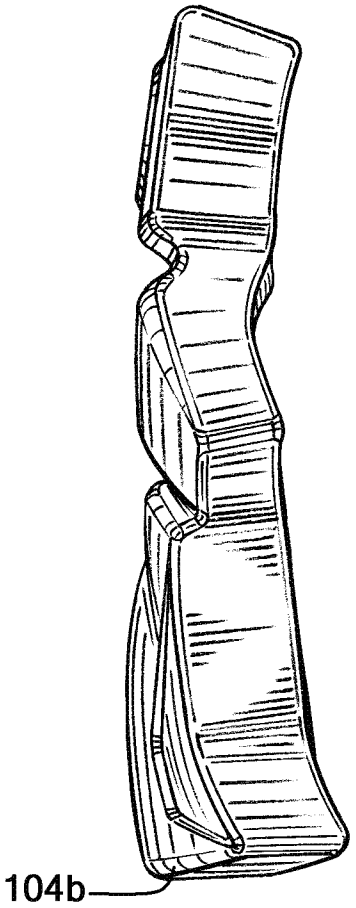
FIG. 10 is a front view of the jaw pad of the face frame padding assembly.

As shown in FIGS. 8 and 11, the brow pad 102 and the jaw pads 104 are each made from a single type of padding material. Preferably, each of the brow pad 102 and the jaw pads 104 are molded as a single, unitary pad. Thus, the brow pad 102 is molded to form a single piece, and the jaw pad 104 is molded to form a single piece. In one embodiment the brow pad 102 and the jaw pads 104 are injection molded. In another embodiment, the jaw pad 104 is formed from at least two portions that are molded and positioned adjacent each other, thereby precluding an appreciable interruption or discontinuity between the portions. In this embodiment, the jaw pad 104 has a substantially uniform thickness at the region where the portions are adjacently positioned and over the length of the jaw pad 104. In the event the jaw pad 104 comprises multiple injection molded portions, the resulting jaw pad 104 mates with the brow pad 102 at the interconnection point 109, as described above. An example of the material used to form the brow pad 102 is DER-TEX SHOXS IV and having a 25% compression deflection (ASTM D-1056 standard) of 8-15 PSI (pounds per square inch) from DER-TEX Corp. of Saco, Maine. The brow pad 102 has a substantially uniform thickness $T_1$ of from about 1 inch to about 1.25 inches, as shown in FIG. 8. The thickness of the brow pad 102 exceeds the thickness of the helmet shell 11, as shown in FIGS. 2A and 2B. Similarly, the jaw pads 104 may also be made from DER-TEX SHOXS IV from DER-TEX Corp. of Saco, Maine. The jaw pads 104 have a thickness $T_2$ of from about 1 inch to about 1.25 inches, as shown in FIG. 11.

Referring to FIGS. 3 and 7, the brow pad 102 has a plurality of vent openings 118*a*, 118*b*. In the installed position of FIG. 2, each brow pad opening 118*a*, 118 *b* is aligned with an opening in the helmet shell 11. The alignment of the vent openings 118*a*, 118*b* with the helmet shell openings allows warm air to vent or escape from the helmet 10, to increase the comfort of the wearer 50. Referring to FIG. 7, a pair of internal channels 119*a* extend from an intermediate portion of the lower edge 107 to the rear edge 102*a*, and a pair of peripheral channels 119*b* extend from a peripheral portion of the lower edge 107 to the peripheral edge of the brow pad 102, preferably proximate the notch 106*d*. Preferably, the brow pad 102 has a curvilinear configuration, and the channels 119*a, b* facilitate flexing of the brow pad 102.

Figure 12:
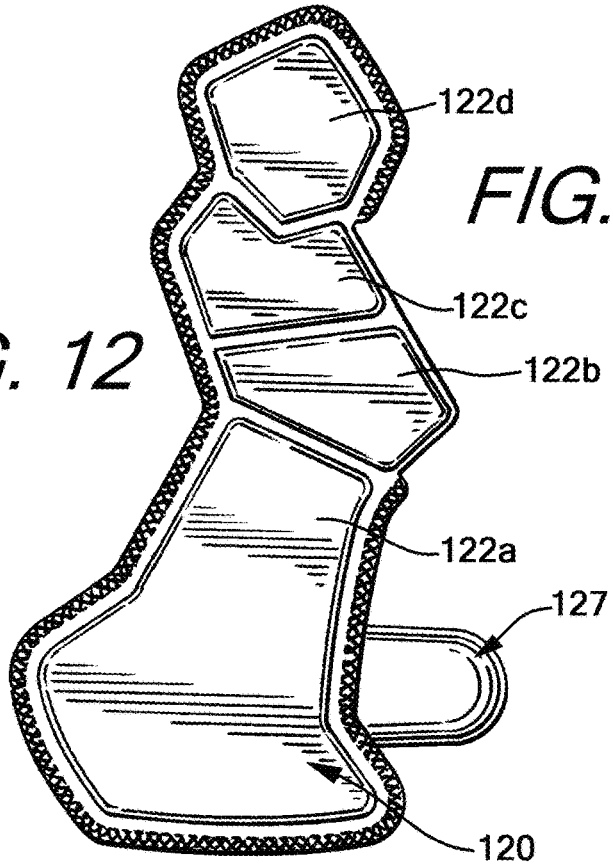
FIG. 12 is a first side view of the jaw pad of the face frame padding assembly positioned within a padding liner.
Figure 13:
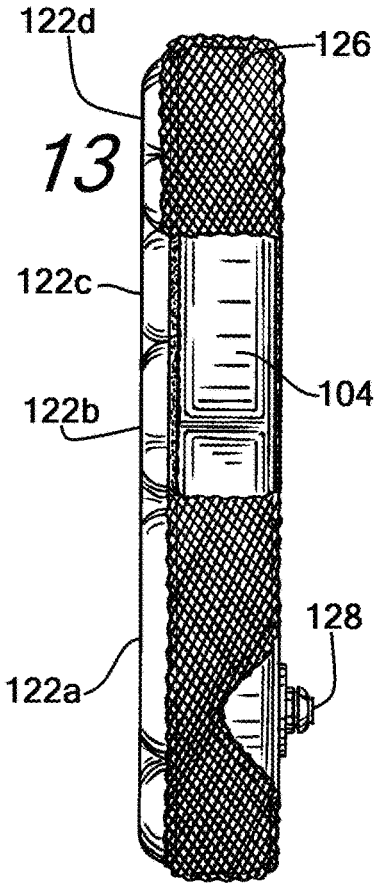
FIG. 13 is an end side view of the jaw pad of the face frame padding assembly positioned within a padding liner.

As shown in FIGS. 12-15, the jaw pad 104 is removably positioned within a liner assembly 120. Preferably, the liner assembly 120 is treated with an anti-bacterial and/or anti-fungal application and is washable. The liner assembly 120 comprises at least one cushioning pad 122, preferably a plurality of cushioning pads 122*a*-122*d* (FIGS. 12 and 13). The cushioning pad 122 generally comprises a material that engages the wearer 50 and is softer than the material used to form the jaw pad 104*b*. The cushioning pad 122 may therefore be referred to as a comfort padding, while the jaw pad 104*b* may be referred to as an energy attenuating padding. The liner assembly 120 also comprises a backing material 124, opposite the cushioning pad 122 that engages the inner surface of the helmet shell 11. The backing material 124 may be connected to the cushioning pad 122 by a mesh fabric 126 that engages side portions of the jaw pad 104. The liner assembly 120 includes means for inflation 127 to offer a more customized fit and to account for anatomical differences among wearers 50. Inflation means 127 includes an inflation valve and stem assembly 128 that is in fluid communication with an inflatable chamber 130 positioned between the backing material 124 and the jaw pad 104. The inflatable chamber 130 is adapted to receive a fluid, typically air, supplied through a channel 129 by the inflation valve 128, which extends through an opening in the helmet shell 11. As the inflatable chamber 130 expands, the jaw pad 104 is displaced inward from the helmet shell 11 and towards the wearer 50 of the helmet 10. Thus, a more secure and customized fit may be achieved by the use of the inflation means 130. A conventional hand held pump having an inflation needle may be inserted into the inflation valve 128 to provide the desired amount of fluid, or air, into the chamber 130.

Turning to FIGS. 16A-20, the crown pad assembly 110, the side pad assembly 112, and the occipital cradle pad assembly 114 are shown removed from the helmet 10. The crown pad assembly 110 comprises a plurality of discrete energy attenuation elements or pad elements 132 that have a hexagonal configuration. The pad elements 132 are spaced apart but interconnected by intervening connection segment 146. Because the pad elements 132 are discontinuous from each other, the pad elements 132 behave independently during use of the helmet 10—the response of a first pad element 132 to an impact force applied to the helmet 10 does not influence the response of a second pad element 132 to the impact force. Due to their hexagonal configuration and relative positioning, the leading portions of adjacent pad elements 132 of the crown pad assembly 110 define a group of crown recesses 111 (see FIGS. 16A-16C) that are configured to engage with the teeth 102*b* (see FIG. 6) of the rear portion of the brow pad 102. Accordingly, the brow pad 102 has three portions—the rear portion and both side portions—that engage with other pads of the internal padding system 100. The rear portion of the brow pad 102 engages the crown pad assembly 110, while the side portions engage the jaw pads 104*a*, 104*b*.

Figure 18:
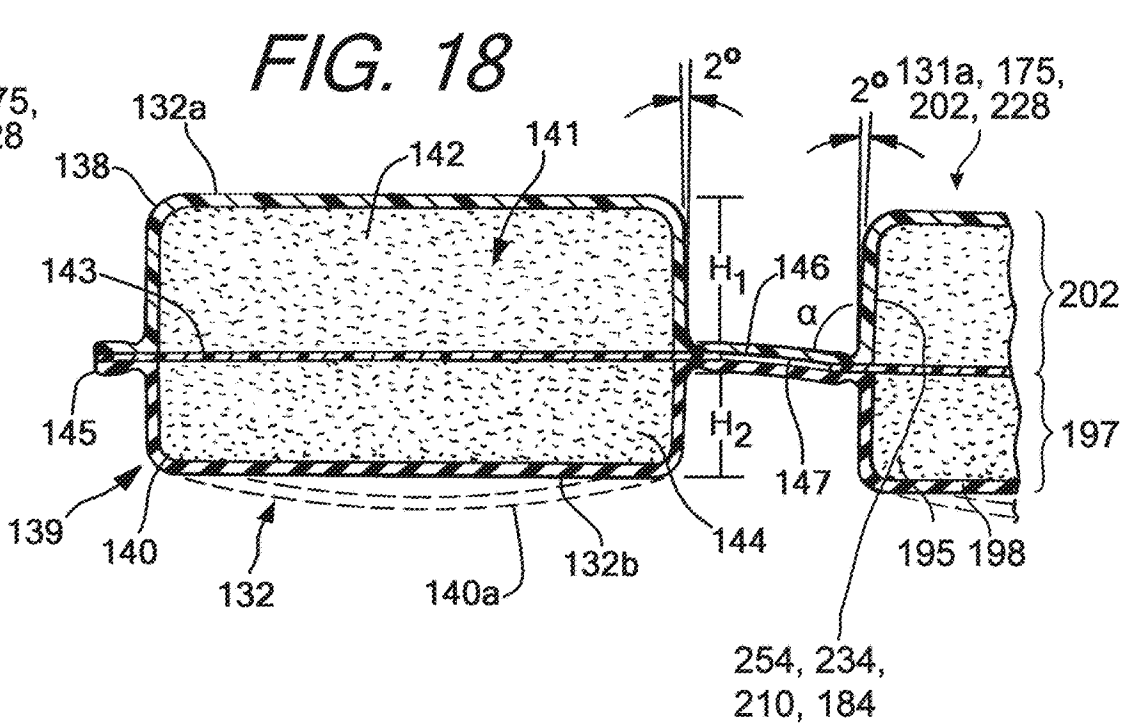
FIG. 18 is a sectional view of the pad element taken through line 18-18 of FIG. 17.

The crown pad assembly or crown energy attenuation assembly 110 further comprises means for inflation including an inflation valve 134 to customize the fit of the crown pad assembly 110. The inflation valve 134 is adapted to provide an inflation fluid, such as air, to a portion of the hexagonally shaped pad elements 132. Referring to FIGS. 17 and 18, the hexagonal pad element 132 comprises a first housing portion 138 and a second housing portion 140 that are joined to form a housing enclosure 139 that encases a pad member 141. The pad member 141 comprises a first pad member portion 141 a with energy (or force) attenuating pad material 142 that resides within the first housing portion 138 and a second pad member portion 141 *b* with energy (or force) attenuating pad material 144 that resides within the second housing portion 140. FIG. 18 shows that the first and second pad member portions 141 *a*, 141 *b* have substantially the same configuration, including outer perimeter configuration, as the housing portions 138, 140 of the housing enclosure 139 that encase and contain the first and second pad member portions 141 *a*, 141 *b*, respectively. The energy attenuating pad material 142 is preferably a PVC nitrile foam or polyurethane foam, such as DER-TEX VN 600 PVC nitrile foam, having a density of at least approximately 5 pounds per cubic foot (PCF) and at least approximately a 25% compression deflection (ASTM D-1056 standard) of 8 pounds per square inch (PSI). In another embodiment, the pad material 142 is a "comfort pad material," which is substantially different than energy attenuating pad material and is described in U.S. Pat. No. 3,882,547. As such, the first material 142 may be different from the second material 144. A separation layer 143 is positioned between the two pad materials 142, 144 and extends between opposed seams 145 formed from joining side walls of the housing portions 138, 140. As best shown in FIG. 18, an angle alpha ($\alpha$) that is approximately 90 degrees is formed between the connection segment 146 and (i) the first side wall 254 and the second side wall 255 (see FIG. 16C) of the first energy attenuation member 175 (and its first upper housing 228) and (ii) the first side wall 260, the second side wall 261 and the third side wall 262 (see FIG. 16C) of the second energy attenuation member 176. In one embodiment, the separation layer 143 has a thickness of 0.01 inch. The separation layer 143 is formed from an airtight material, such as vinyl, that partitions or separates the pad element 132 into a first chamber (or section) 132 *a* including the housing portion 138 and the pad material 142, and a second chamber (or section) 132 *b* including the housing portion 140 and the pad material 144. Thus, the pad element 132 is internally partitioned to include an inflatable second chamber 132 *b* and an un-inflatable first chamber 132 *a*. Although only the crown pad assembly 110 is shown as having a partitioned pad element 132 resulting from the separation layer 145, it is understood that the separation layer and partitioning could be employed with the elements of the side pad assembly 112 and the occipital cradle pad assembly 114.

As demonstrated by the different hatching lines in FIG. 18, the first and second housing portions 138, 140 are fabricated from different materials having dissimilar material properties, thereby combining to affect how the pad element 132 responds when an impact is applied to the helmet shell 11 and transmitted to the crown pad assembly 110. In one preferred embodiment, the first housing portion 138 is vacuum formed from a first type of vinyl, while the second housing portion 140 is vacuum formed from second type of vinyl. A vacuum forming process can be employed to fabricate the first and second housing portions 138, 140 from sheet stock to create a well that accommodates the pads 142, 144, respectively. From there, the first and second housings 138, 140 are sealed to form a scam 145 of the hexagonal pad element 132, wherein the separation layer 143 extends between opposed seams 145. The first and second housings 138, 140 are joined through heat sealing process such as high frequency welding, such as radio frequency welding. As shown in FIG. 18, the first housing 138 has a sidewall height H1 that exceeds a sidewall height H2 of the second housing 140. This means that the seam 145 and the separation layer 143 are offset from a midpoint of the overall sidewall height of the pad element 132. In one embodiment, the first sidewall height H1 is 0.75 inch and the second sidewall height H2 is 0.5 inch. Because of these different sidewall heights H1, H2, the first chamber 132*a* has a greater volume than the second chamber 132*b* in an un-inflated state. As mentioned above, the connection segment 146 resides between hexagonal pad elements 132. The connection segment 146 includes an upper portion formed from the same sheet stock material as the first housing 138 and a lower portion formed from the same stock sheet material as the second housing 140. The connection segment 146 also includes a channel 147 extending between adjacent pad elements 132.

Figure 16A:
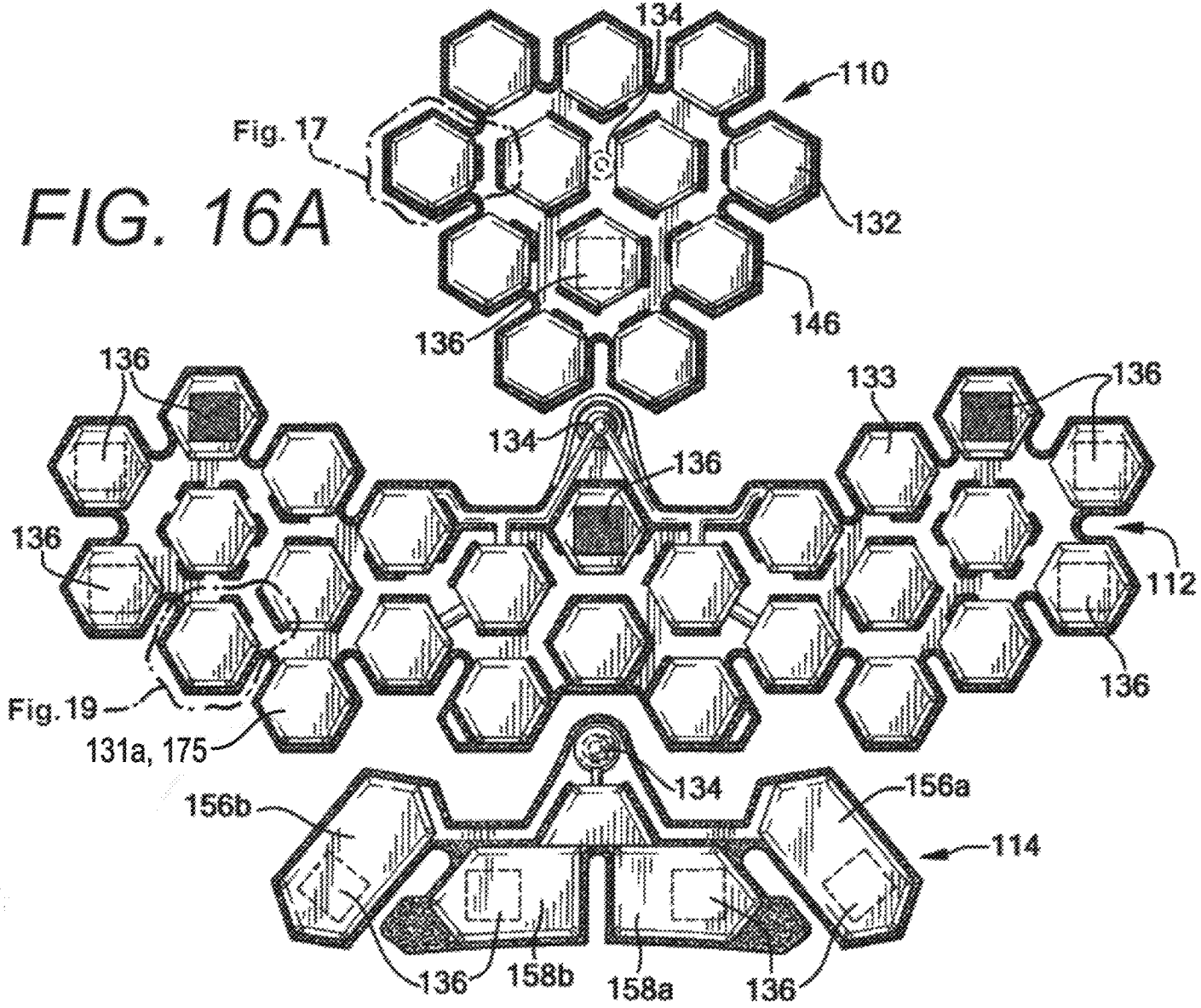
FIG. 16A is a view of a crown pad assembly, a side pad assembly, and an occipital pad assembly of the padding assembly in an uninstalled state.
Figure 16B:
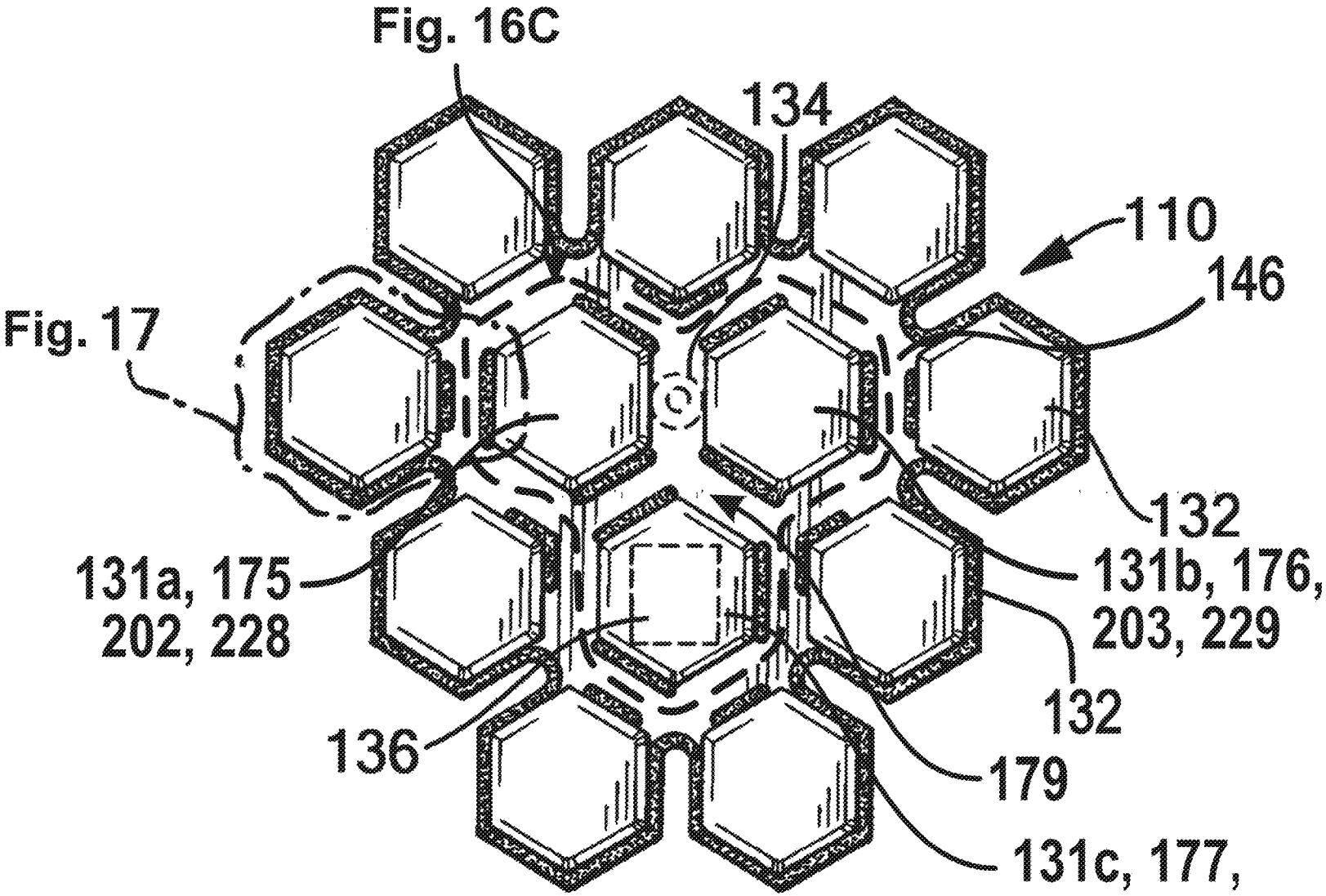
FIG. 16B is a view of the crown pad assembly of the padding assembly in an uninstalled state.
Figure 16C:
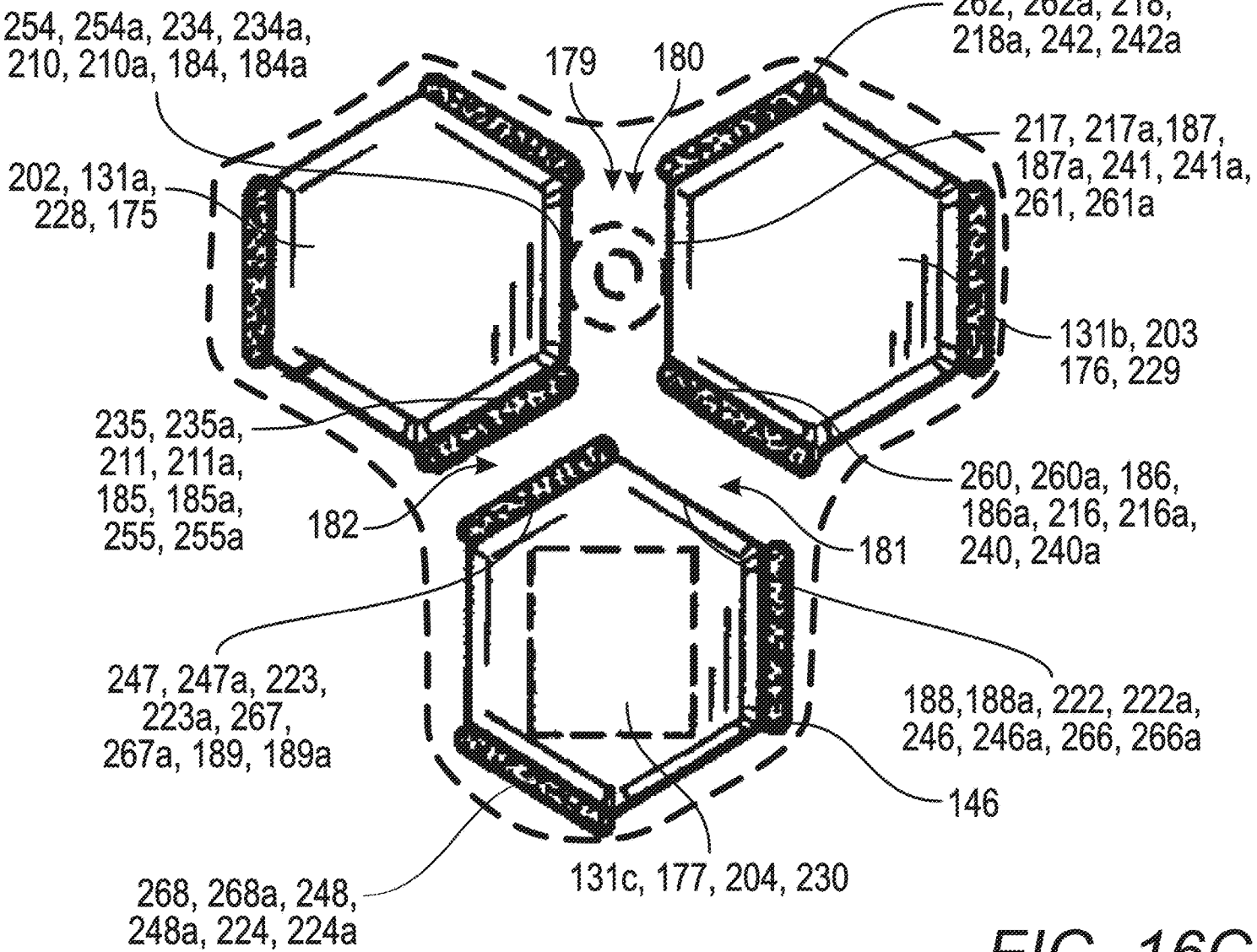
FIG. 16C is a detailed view of an extent of the crown pad assembly of the padding assembly in an uninstalled state.
Figure 17:
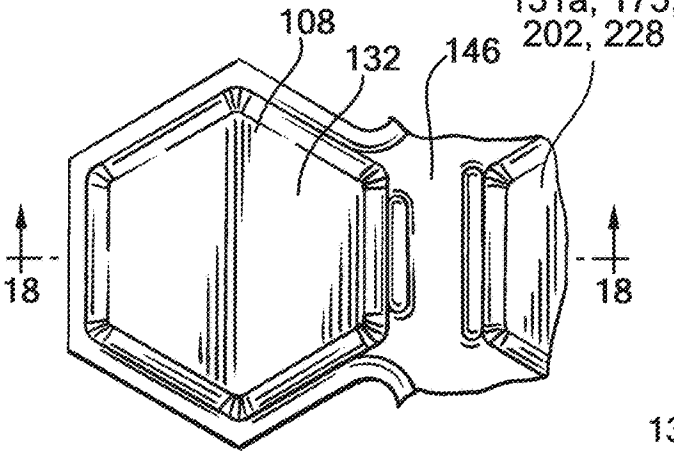
FIG. 17 is a detailed view of a pad element of the crown pad assembly.

Referring to FIGS. 16B-C, and 18, the crown pad assembly 110 includes multiple energy attenuation elements 132 that comprise: (i) a first energy attenuation pad element 131*a* with: (a) a first upper assembly 202 that includes a first upper housing (or a first housing) 228 and a first energy attenuation member 175 having an arrangement of six sides, which includes a first side 184 and a second side 185, and (b) a first lower assembly 197 that includes a first lower housing 198 and an energy attenuation member 199, (ii) a second energy attenuation pad element 131*b* with: (a) a second upper assembly 203 that includes a second upper housing (or a second housing) 229 and a second energy attenuation member 176 having an arrangement of six sides, which includes a first side 186 and a second side 187, and (b) a second lower assembly that includes a second lower housing and an energy attenuation member, and (iii) a third energy attenuation pad element 131*c* with: (a) a third upper assembly 204 that includes a third upper housing (or a third housing) 230 and a third energy attenuation member 177 having an arrangement of six sides, which includes a first side 188 and a second side 189, and (b) a third lower assembly that includes a third lower housing and an energy attenuation member. The first and second sides 184-189 of the first, second, and third energy attenuation members 177, 178, 179 are substantially planar and have approximately the same length, as shown in FIGS. 16B-16C, 17, and 18. Based on this configuration, the first and second sides 184-189 have edge segments 184*a*-189*a* that are: (a) substantially linear, (b) substantially the same length, and (c) are positioned adjacent or abut an extent of a crown pad assembly gap 179. This configuration also places: (i) the first edge segment 184*a* of the first energy attenuation member 175 substantially parallel with the second edge segment 187*a* of the second energy attenuation member 176, (ii) the first edge segment 188*a* of the third energy attenuation member 177 substantially parallel with the first edge segment 186*a* of the second energy attenuation member 186 and (iii) the second edge segment 189*a* of the third energy attenuation member 177 substantially parallel with the second edge segment 185*a* of the first energy attenuation member 175.

The first energy attenuation element 131*a* has an arrangement of six sides, which includes a first side 210, a second side 211, and a third side 212. The second energy attenuation element 131*b* also has an arrangement of six sides, which includes a first side 216, a second side 217, and a third side 218. Further, the third energy attenuation element 131*c* has an arrangement of six sides, which includes a first side 222, a second side 223, and a third side 224. The first, second, and third sides 210-212, 216-218, 222-224 of the first, second, and third energy attenuation elements 131*a*, 131*b*, 131*c* are substantially planar and have approximately the same length, as shown in FIGS. 16B-16C, 17, and 18. Based on this configuration, the first, second, and third sides 210-212, 216-218, 222-224 have edge segments 210*a*-212*a*, 216*a*-218*a*, 222*a*-224*a* that are: (a) substantially linear, (b) substantially the same length, and (c) are positioned adjacent or abut an extent of a crown pad assembly gap 179. This configuration also places: (i) the first edge segment 210*a* of the first energy attenuation element 131*a* substantially parallel with the second edge segment 217*a* of the second energy attenuation element 131*b*, (ii) the first edge segment 222*a* of the third energy attenuation element 131*c* substantially parallel with the first edge segment 216*a* of the second energy attenuation element 131*b*, and (iii) the second edge segment 223*a* of the third energy attenuation element 131*c* substantially parallel with the second edge segment 211*a* of the first energy attenuation element 131*a*.

The first upper housing 228 of the crown pad assembly 110 has an arrangement of six side walls, which includes a first side wall 254, a second side wall 255, and a third side wall 256. The second upper housing 229 of the crown pad assembly 110 also has an arrangement of six side walls, which includes a first side wall 260, a second side wall 261, and a third side wall 262. Further, the third upper housing 230 of the crown pad assembly 110 has an arrangement of six side walls, which includes a first side wall 266, a second side wall 267, and a third side wall 268. The first, second, and third side walls 254-256, 260-262, 266-268 of the first, second, and third upper housings 228-230 are substantially planar, have approximately the same length, as shown in FIGS. 16B-16C, 17, and 18, and obtuse angles are formed by adjacent walls. For example, an obtuse angle is formed between an extent of the first side wall 254, 260, 266 and an extent of the second side walls 255, 261, 267, when the crown energy attenuation assembly is removed from the helmet shell 11 and is in an uninstalled state.

Based on this configuration, the first side wall 254 of the first housing 228 is substantially parallel with the second side wall 255 of the second housing 229. Additionally, the first side wall 260 of the second housing 229 is substantially parallel with the first side wall 266 of the third housing 230. Finally, the second side wall 255 of the first housing 228 is substantially parallel with the second side wall 267 of the third housing 230. This configuration also allows the first, second, and third side walls 254-256, 260-262, 266-268 have edge segments 254*a*-256*a*, 260*a*-262*a*, 266*a*-268*a* that are: (a) substantially linear, (b) substantially the same length, and (c) are positioned adjacent or abut an extent of a crown pad assembly gap 179. This configuration also places: (i) the first edge segment 254*a* of the first upper housing 228 substantially parallel with the second edge segment 261*a* of the second upper housing 229, (ii) the first edge segment 266*a* of the third upper housing 230 substantially parallel with the first edge segment 260*a* of the second upper housing 229, and (iii) the second edge segment 267*a* of the third upper housing 230 substantially parallel with the second edge segment 255*a* of the first upper housing 228.

Also, as best shown in FIG. 16C, the first, second, and third upper housings 228-230 each include an inner wall that extends between the side walls 254-256, 260-262, 266-268 of each housing 228-230. For example, a first inner wall of the first upper housing 228 extends between and is coupled to the first side wall 254, the second side wall 255, and the third side wall 256, wherein said first inner wall is adapted to make contact with a player's head when the football helmet is worn by said player.

Again referring to FIGS. 16A-16C, the crown assembly gap 179 separates: (i) the first, second and third energy attenuation members 175, 176, 177, (ii) the first, second, and third upper housings 228, 229, 230, (iii) the first, second, and third upper assemblies 202, 203, 204, and (iv) an extent of the first, second, and third energy attenuation elements 131*a*, 131*b*, 131*c*, of the crown pad assembly 110 from each other. In particular, the crown assembly gap 179 is a collection of smaller, distinct gaps, namely: (i) a first crown gap 180, (ii) a second crown gap 181, and (iii) a third crown gap 182. The first crown gap 180 is formed between: (a) the first side 184 of the first energy attenuation member 175 and the second side 187 of the second energy attenuation member 176, (b) the first side wall 254 of the first upper housing (or first housing) 228 and the second side wall 261 of the second upper housing (or second housing) 229, and (c) an extent of the first side 210 of the first energy attenuation element 131*a* and an extent of the second side 217 of the second energy attenuation element 131*b*. The second crown gap 181 formed between: (a) the first side 186 of the second energy attenuation member 176 and the first side 188 of the third energy attenuation member 177, (b) the first side wall 266 of the third upper housing 230 and the first side wall 260 of the second upper housing 229, and (c) an extent of the first side 222 of the third energy attenuation element 131*c* and an extent of the first side 216 of the second energy attenuation element 131*b*. The third crown gap 182 formed between: (a) second side 189 of the third energy attenuation member 177 and the second side 185 of the first energy attenuation member 175, (b) the second side wall 267 of the third upper housing 230 and the second side wall 255 of the first upper housing 228, (c) an extent of the second side 223 of the third energy attenuation element 131*c* and an extent of the second side 211 of the first energy attenuation element 131*a*. Based on the above described configuration 16A-16C the first crown gap 180 is also formed between: (a) the first edge segment 184*a* of the first energy attenuation member 175 and the second edge segment 187*a* of the second energy attenuation member 176, (b) the first edge segment 254*a* of the first upper housing 228 and the second edge segment 261*a* of the second upper housing 229, and (c) the first edge segment 234*a* of the first upper assembly 202 and the second edge segment 241*a* of the second upper assembly 203, and (d) the first edge segment 210*a* of the first energy attenuation element 131*a* and the second edge segment 217*a* of the second energy attenuation element 131*b*. The second crown gap 181 is also formed between: (a) the first edge segment 186*a* of the second energy attenuation member 176 and the first edge segment 188*a* of the third energy attenuation member 177, (b) the first edge segment 266*a* of the third upper housing 230 and the first edge segment 260*a* of the second upper housing 229, (c) the first edge segment 246*a* of the third upper assembly 204 and the first edge segment 240*a* of the second upper assembly 203, and (d) the first edge segment 222*a* of the third energy attenuation element 131*c* and the first edge segment 216*a* of the second energy attenuation element 131*b*. The third crown gap 182 is also formed between: (a) second edge segment 189*a* of the third energy attenuation member 177 and the second edge segment 185*a* of the first energy attenuation member 175, (b) the second edge segment 267*a* of the third upper housing 230 and the second edge segment 255*a* of the first upper housing 228, (c) the second edge segment 247*a* of the third upper assembly 204 and the second edge segment 235*a* of the first upper assembly 202, and (d) the second edge segment 223*a* of the third energy attenuation element 131*c* and the second edge segment 211*a* of the first energy attenuation element 131*a*.

To adjust the fit of the crown pad 110, inflation fluid from the valve 134 can be supplied through the channel 147 to the second chamber 132*b* of the various pad elements 132. As denoted by the dotted lines, the lower portion of FIG. 18 shows the second chamber 132*b* in an inflated state, wherein inflation fluid has been supplied through the channel 147 to the second chamber 132*b* that is adjacent the inner surface 17 of the shell 11 when the crown pad 11 is installed within the helmet 10. When sufficiently inflated, the housing 140*a* of the second chamber 132*b* assumes a curvilinear configuration that substantially conforms to the curvilinear configuration of the inner shell surface 17 (see FIG. 18). Because the separation layer 143 is airtight, the first chamber 132*a* does not inflate and its housing 138 is not altered (e.g., curved or domed due to inflation) and remains generally linear, whereby a greater amount of the pad material 144 in the first chamber 132*a* remains in contact with the wearer's head 51. These attributes of the pad elements 132 improve both the fit of the crown pad 110 and the padding assembly 100 relative to the wearer's head 51, and the stability of the helmet 10 on the wearer's head 51, including when impact forces are applied to the helmet shell 11 and/or the faceguard 12. The channel 147 in the pad element connection section 146 allows inflation fluid to pass between various pad elements 132 for inflation or deflation of the second chamber 132*b*.

Figure 20:
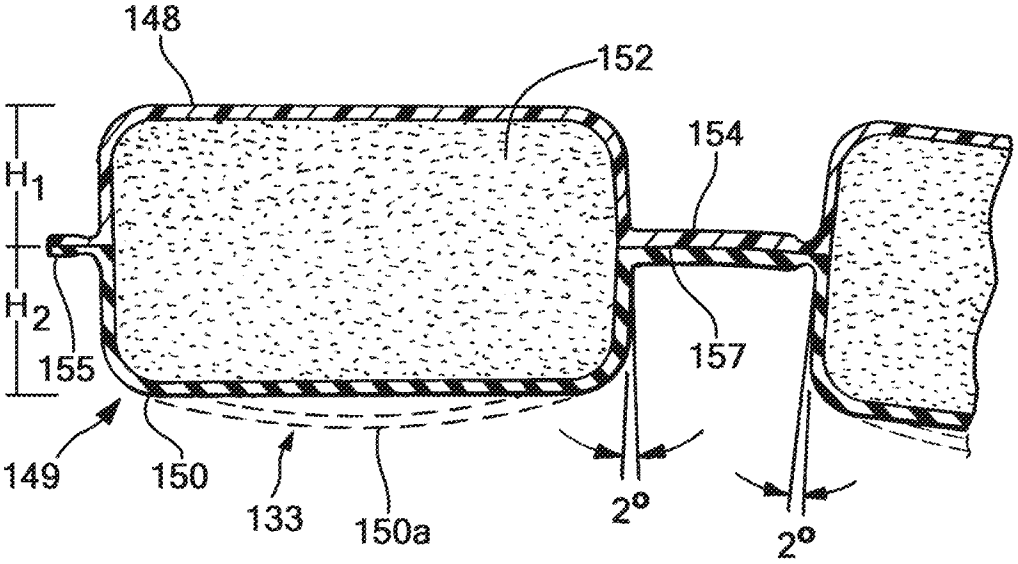
FIG. 20 is sectional view of the pad element taken through line 20-20 of FIG. 19.
Figure 19:
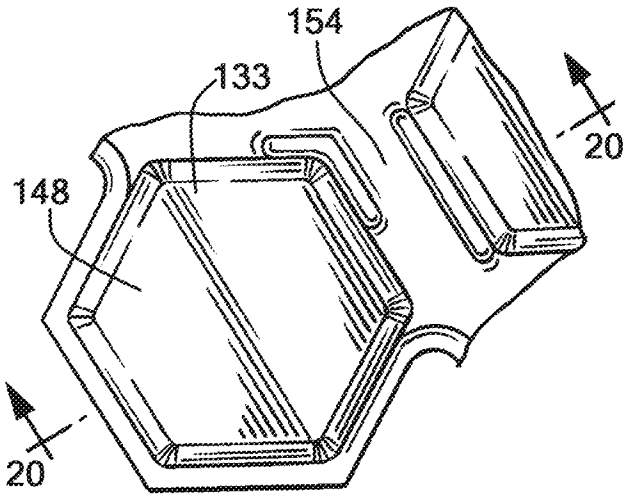
FIG. 19 is a detailed view of a pad element of the side pad assembly.

FIGS. 16A, 16D-16E, 19 and 20 show the side pad assembly 112 of the internal pad assembly 100, which also includes a plurality of discrete hexagonal energy attenuation or pad elements 133. The side pad assembly 112 also includes an inflation valve 134 to supply inflation fluid through a channel 134*a* to the hexagonally shaped pad elements 133. The pad elements 133 are spaced apart but are interconnected by an intervening connection segment 154. The pad element 133 comprises a first housing portion 148 and a second housing portion 150 that are joined from a housing 149 that encase a pad member 152. As shown in FIG. 20, the pad member 152 of the side pad assembly 112 has substantially the same configuration, including outer perimeter configuration as the housing portions 148, 150 and thus the housing 149 that encases and contains the pad member 152. Although the pad member 152 is shown as being formed from a single type of material, the pad member 152 could be formed from two material types (as explained above). Thus, the pad member 152 could include energy attenuating pad material, comfort pad material, or a combination of both. Referring to the different hatching lines in FIG. 20, the first and second housing portions 148, 150 are fabricated from different materials having dissimilar material properties, thereby altering how the pad element 133 responds when an impact is applied to the helmet shell 11 and transmitted to the side pad assembly 112. In one embodiment, the first housing portion 138 is fabricated from a first type of vinyl, while the second housing portion 140 is fabricated from a second type of vinyl. As explained above, a vacuum forming process can be employed to seal the first and second housings 148, 150 at a seam 155. As shown in FIG. 20, the first housing 148 has a sidewall height H1 that is substantially the same as a sidewall height H2 of the second housing 150. Therefore, the seam 155 is located at a midpoint of the overall sidewall height of the pad element 133. The connection segment 154 also includes a channel 157 extending between adjacent pad elements 133. To adjust the fit of the side pad 112, inflation fluid from the valve 134 can be supplied through the channel 157 to the various pad elements 133. The lower portion of FIG. 20 shows a second housing 150*a* in an inflated position, wherein inflation fluid has been supplied through the channel 157 to the pad element 152 that is adjacent the wearer 50. The inflation of the pad element 133 provides a more precise fit of the side pad assembly 112 on the wearer 50 while accommodating the wearer's anatomical differences. Referring to FIGS. 2B, 9 and 16A, a first leading pad element 133*b* and a second leading pad element 133*c* define a cavity 137 (see FIG. 16A) configured to receive a rear projection 108*e* formed from a first rear segment 108*f* and a second rear segment 108*g* of the connection portion 108 of the jaw pad 104. As shown in the assembled position of FIG. 2B, the rear projection 108*e* is received by the cavity 137 wherein the first rear segment 108*f* is positioned adjacent the first leading pad element 133*b* and the second rear segment 108*g* is positioned adjacent the second leading pad element 133*c*. Accordingly, the connection portion 108 is positioned between the crown pad 110 and the brow pad 102, and provides for mating of the jaw pad 104 with both the crown pad 110 and the brow pad 102.

Figure 16D:
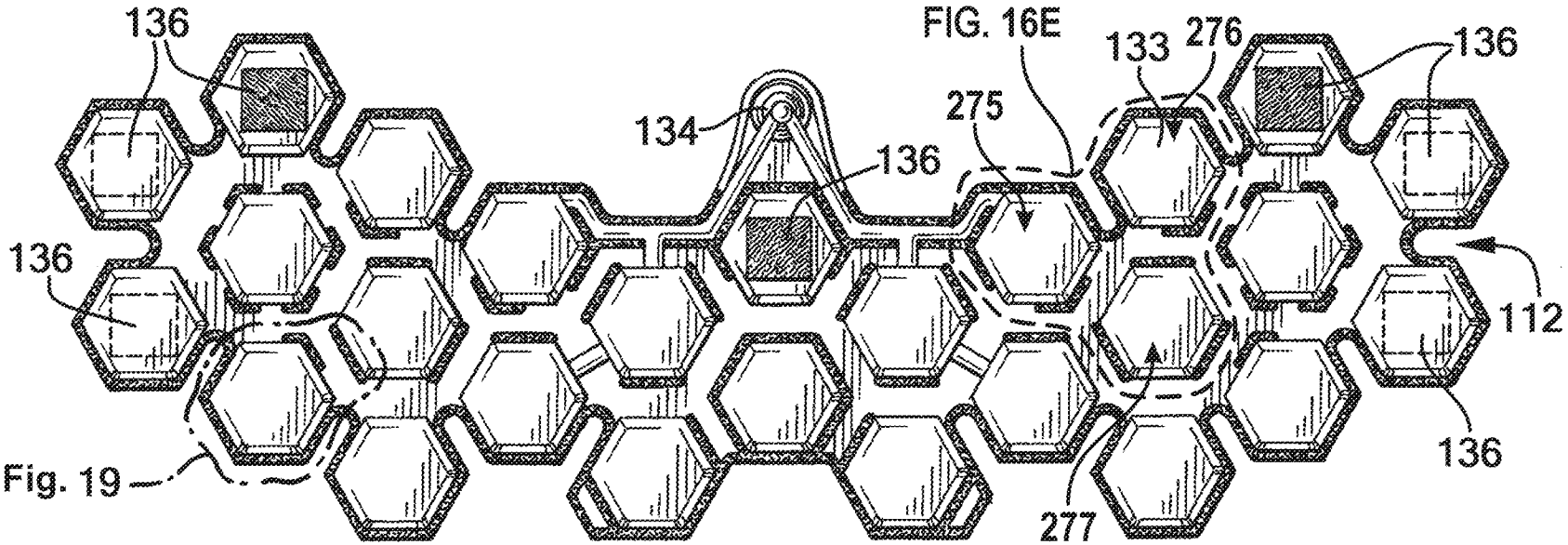
FIG. 16D is a view of the side pad assembly of the padding assembly in an uninstalled state.
Figure 16E:
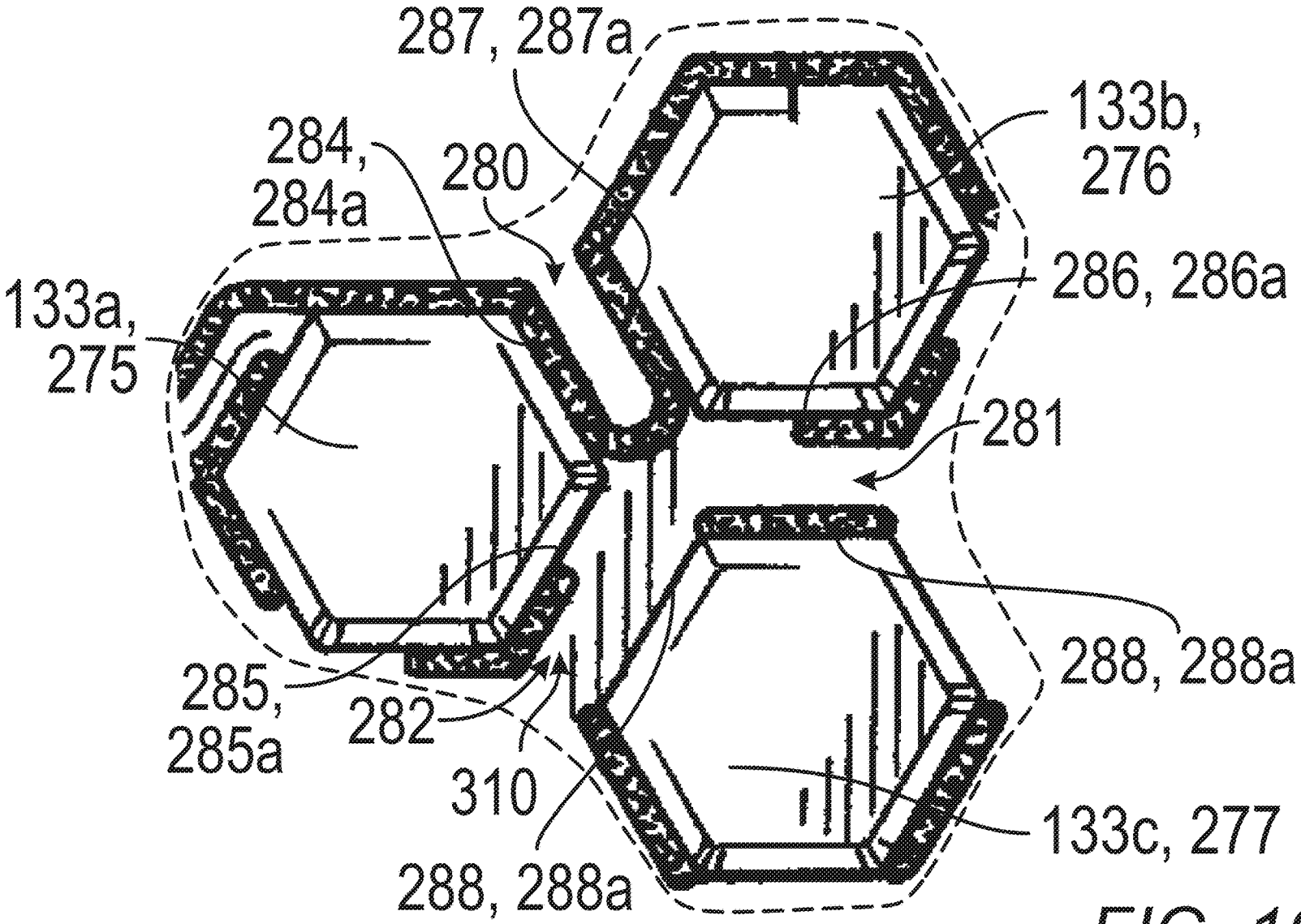
FIG. 16E a detailed view of an extent of the side pad assembly of the padding assembly in an uninstalled state.

Referring to FIGS. 16A, 16D-E, the side pad assembly 112 includes multiple pad elements 133 that comprise: (i) a first energy attenuation (or pad) element 133*a* with a first energy attenuation member 275 having an arrangement of six sides, which includes a first side 284 and a second side 285, (ii) a second energy attenuation (or pad) element 133*b* with a second energy attenuation member 276 having an arrangement of six sides, which includes a first side 286 and a second side 287, and (iii) a third energy attenuation (or pad) element 133*c* with a third energy attenuation member 277 having an arrangement of six sides, which includes a first side 288 and a second side 289. The first and second sides 284-289 of the first, second and third energy attenuation members 277, 278, 279 are substantially planar and have approximately the same length, as shown in FIGS. 16D-16E, 19, and 20. Based on the configuration, the first and second sides 284-289 have edge segments 284*a*-289*a* that are: (i) substantially linear, (ii) substantially the same length, and (iii) are positioned adjacent or abut an extent of a side pad assembly gap 301. This configuration also places: (i) the first edge segment 284*a* of the first energy attenuation member 275 substantially parallel with the second edge segment 287*a* of the second energy attenuation member 276, (ii) the first edge segment 288*a* of the third energy attenuation member 277 substantially parallel with the first edge segment 286*a* of the second energy attenuation member 286 and (iii) the second edge segment 289*a* of the third energy attenuation member 277 is-substantially parallel with the second edge segment 285*a* of the first energy attenuation member 275.

Again referring to FIGS. 16A, 16D-E, the side pad assembly gap 310 separates the first, second, and third energy attenuation members 275, 276, 277 of the side pad assembly 112 from each other. In particular, the side assembly gap 301 is comprised of: (i) a first side gap 280 formed between the first side 284 of the first energy attenuation member 275 and the second side 287 of the second energy attenuation member 276, (ii) a second side gap 281 formed between the first side 286 of the second energy attenuation member 276 and the first side 288 of the third energy attenuation member 277, and (iii) a third side gap 282 formed between second side 289 of the third energy attenuation member 277 and the second side 285 of the first energy attenuation member 275. Based on this configuration: (i) the first side gap 280 is also formed between the first edge segment 284*a* of the first energy attenuation member 275 and the second edge segment 287*a* of the second energy attenuation member 276, (ii) the second side gap 281 is also formed between the first edge segment 286*a* of the first energy attenuation member 276 and the first edge segment 288*a* of the third energy attenuation member 277, and (iii) the third gap 282 is also formed between second edge segment 289*a* of the third energy attenuation member 277 and the second edge segment 285*a* of the first energy attenuation member 275.

Figure 21:
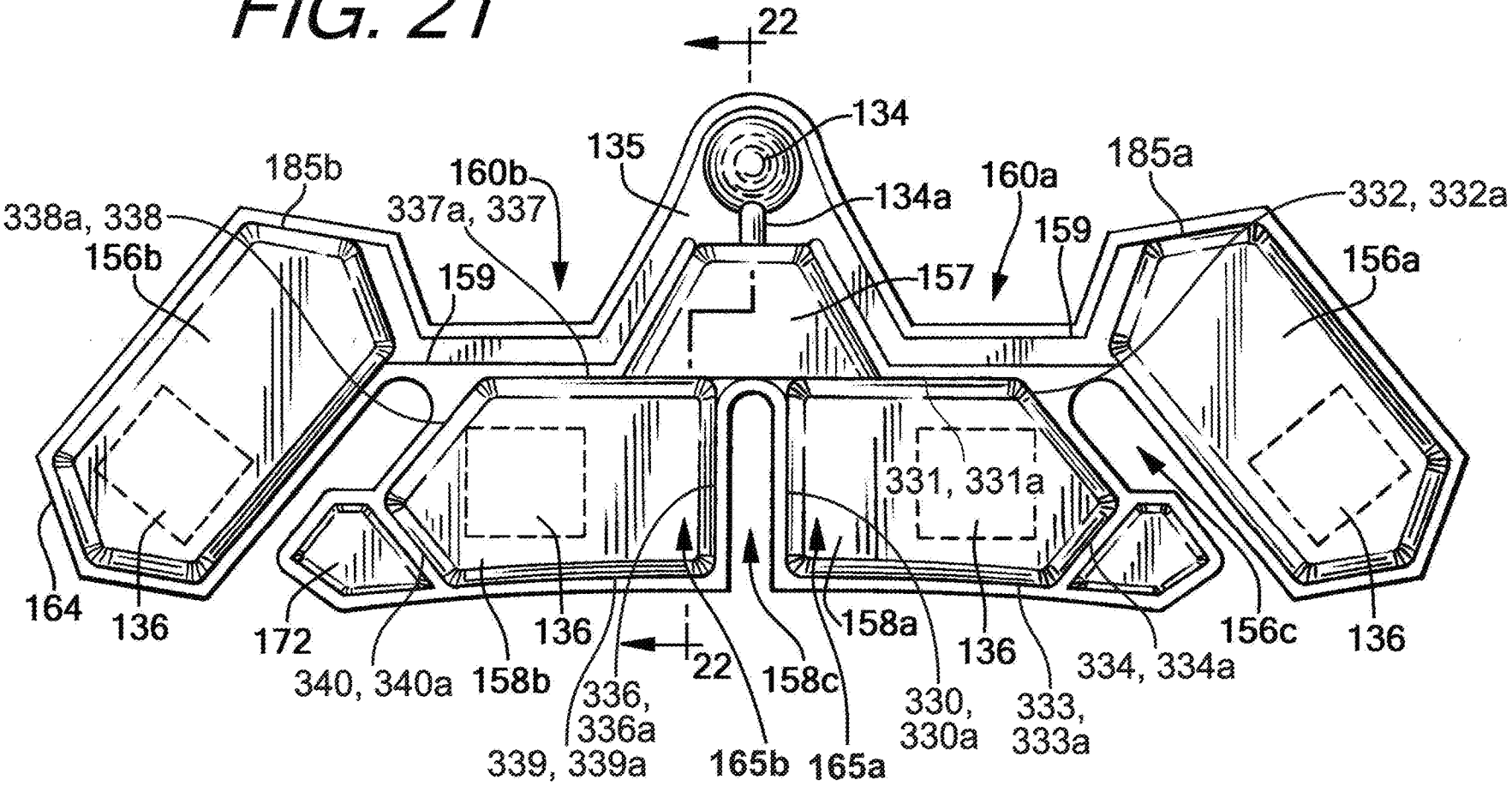
FIG. 21 is a front view of the occipital pad of the padding assembly in an uninstalled state.

FIGS. 16A, 16D-16E, and 21-23 depict the inflatable occipital cradle pad assembly or occipital energy attenuation assembly 114 which, as explained below, fills the space or void V (see FIGS. 22 and 23) below the wearer's occipital protuberance 57 of the occipital bone to cradle and stabilize the helmet 10 on the wearer's head 51. When installed within the shell 11, the occipital pad assembly 114 extends along the rear lower edge 11*b* of the shell 11, wherein no other pad element resides between the occipital pad assembly 114 and the rear lower edge 11*b*. The occipital pad assembly 114 structurally and functionally interacts with the side pad assembly 112 to increase helmet 10 stability during playing of the contact sport, including when the helmet 10 receives an impact or a series of impacts, both of which are common during the play of football, lacrosse and hockey. The occipital pad assembly 114 comprises an arrangement of pad elements that are specifically designed to engage the lower extent of the occipital protuberance 57 of wearer's head 51. The occipital cradle pad assembly 114 comprises: (i) a first peripheral energy attenuation pad element 156*a* and a first peripheral energy attenuation member residing therein (not shown), (ii) a second peripheral energy attenuation pad element 156*b* and a second peripheral energy attenuation member residing therein (not shown), (iii) a central energy attenuation pad element 157, (iv) a first intermediate energy attenuation pad element 158*a* with a first intermediate housing 165*a*, and a first energy attenuation member (not shown), and (v) a second intermediate energy attenuation pad element 158*b* with a second intermediate housing 165*b*, and a second energy attenuation member 322*b* (see FIG. 22). In the embodiment shown, the first and second peripheral pad elements 156*a, b* have a hexagonal configuration that includes a first edge segment 185*a, b* that has a length substantially equal to the length of the first edge segments 184*a* 186*a* 188*a*, 284*a*, 286*a*, 288*a* of the first through the third energy attenuation members 175-177 and 275-277 of the crown pad assembly 110 and the side pad assembly 112, respectively. Additionally, the central pad element 157 has a trapezoidal configuration, and the first and second intermediate pad elements 158*a, b* have a pentagonal configuration. The first and second intermediate pad elements 158*a, b* reside adjacent or below the central pad element 157 and are separated by a central gap 158*c* that extends from a lower edge of the intermediate pad elements 158 to the central pad element 157. The first and second peripheral pad elements 156*a, b* extend outward or peripherally from a main portion of the pad assembly 114 by a connection segment 159. The first and second peripheral pad elements 156*a, b* extend transversely upward past the intermediate pad element 158*a, b* and slightly beyond the central pad element 157. A peripheral slot 156*c* extends transversely between the peripheral pad segment 156*a, b* and the intermediate pad element 158*a, b*, and from the lower edge to the connection segment 159. In the embodiment of FIG. 21, the peripheral slot 156*c* has an initial slot segment leading to an interior slot segment, wherein the width of the latter exceeds the width of the former. The gap 158*c* and the peripheral slots 156*c* facilitate flexing of the occipital cradle pad assembly 114 during installation within the helmet shell 11 and proper positioning of the pad assembly 114 relative to the helmet shell 11.

The occipital cradle pad assembly 114 also comprises an inflation valve 134 residing in an elevated portion 135 of the assembly 114. The inflation valve 134 is adapted to provide an inflation fluid, such as air, to the pad elements or occipital energy attenuation elements 156, 158. An air channel 134 *a* extends from the valve 134 to the pad elements 156, 158. The occipital cradle pad assembly 114 is removably secured to the inner surface 17 of the helmet shell 11 by a connector, such as VELCRO® connector 136. The occipital cradle pad assembly 114 is symmetric about an axis extending through the inflation valve 134 whereby the assembly 114 has first (right) and second (left) portions. A portion of the elevated portion 135, the first peripheral element 156 *a*, the central pad element 157 and the first intermediate element 158 *a* define a first well 160 *a*. Similarly, the elevated portion 135, the second peripheral element 156 *b* and the second intermediate element 158 *ba* define a second well 160 *b*. The combination of the elevated portion 135, the wells 160 *a, b* and the upper portion of the peripheral pad elements 156 *a, b* provide a series of projections and recesses that facilitate engagement of the occipital pad assembly 114 with a lower portion (or trailing edge portion) of the side pad assembly 112. As shown in FIG. 16, the lower portion of the side pad assembly 112 has a central recess 112 *a* that receives the central elevated portion 135, and a pair of intermediate recesses 112 *b, c* wherein each recess 112 *b, c* receives an upper extent of the peripheral pad element 156 *a,b*. When the occipital cradle pad assembly 114 and the side pad assembly 112 are installed in the helmet 10, the central elevated portion 135 is positioned between the helmet shell 11 and the pad element 133 *a* of the side pad assembly 112 adjacent (see FIG. 16A).

Figure 22:
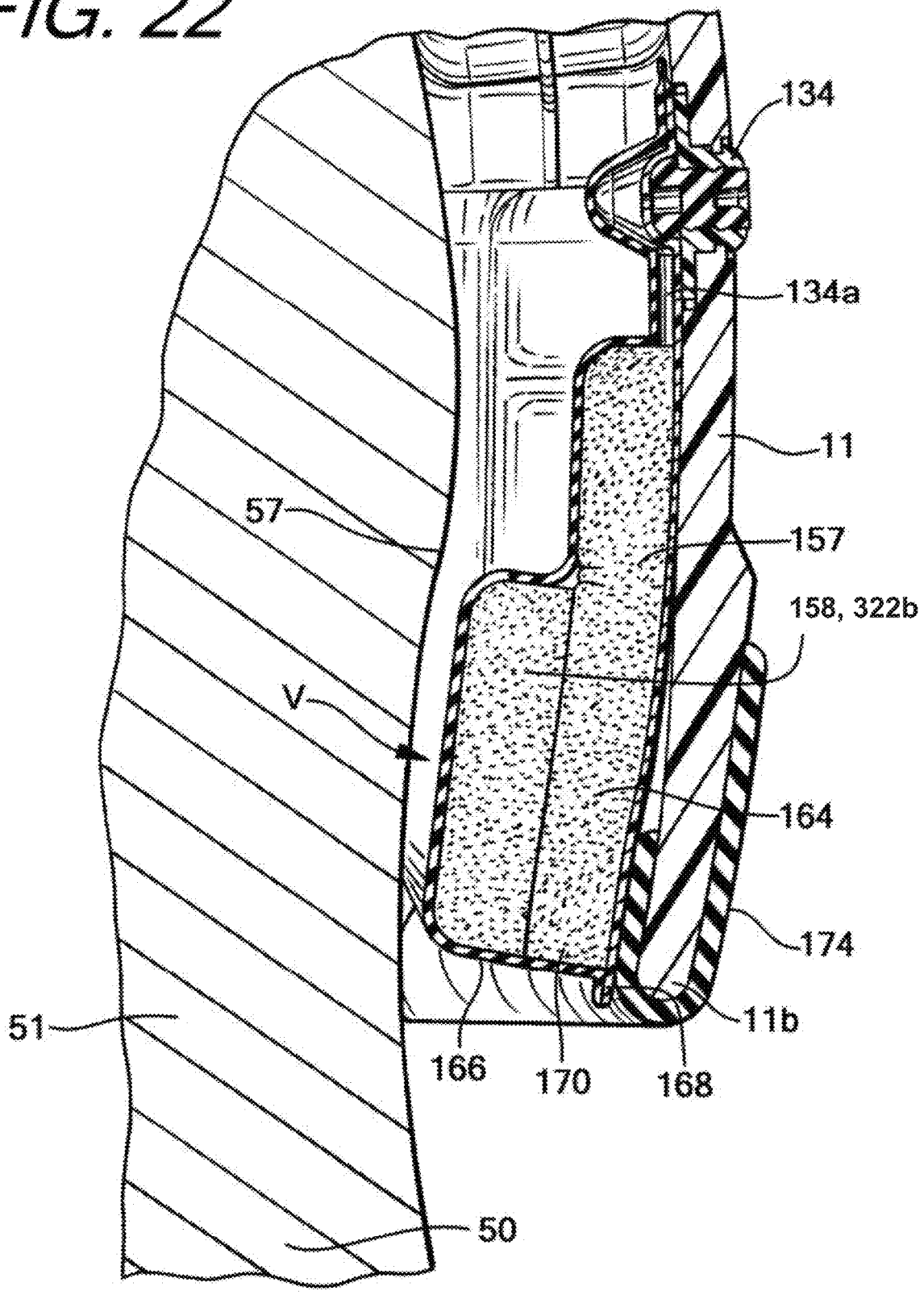
FIG. 22 is a sectional view of the occipital pad taken through line 22-22 of FIG. 21, showing the occipital pad in a deflated state; and, FIG. 23 is a sectional view of the occipital pad taken through line 22-22 of FIG. 21, showing the occipital pad in an inflated state.
Figure 23:
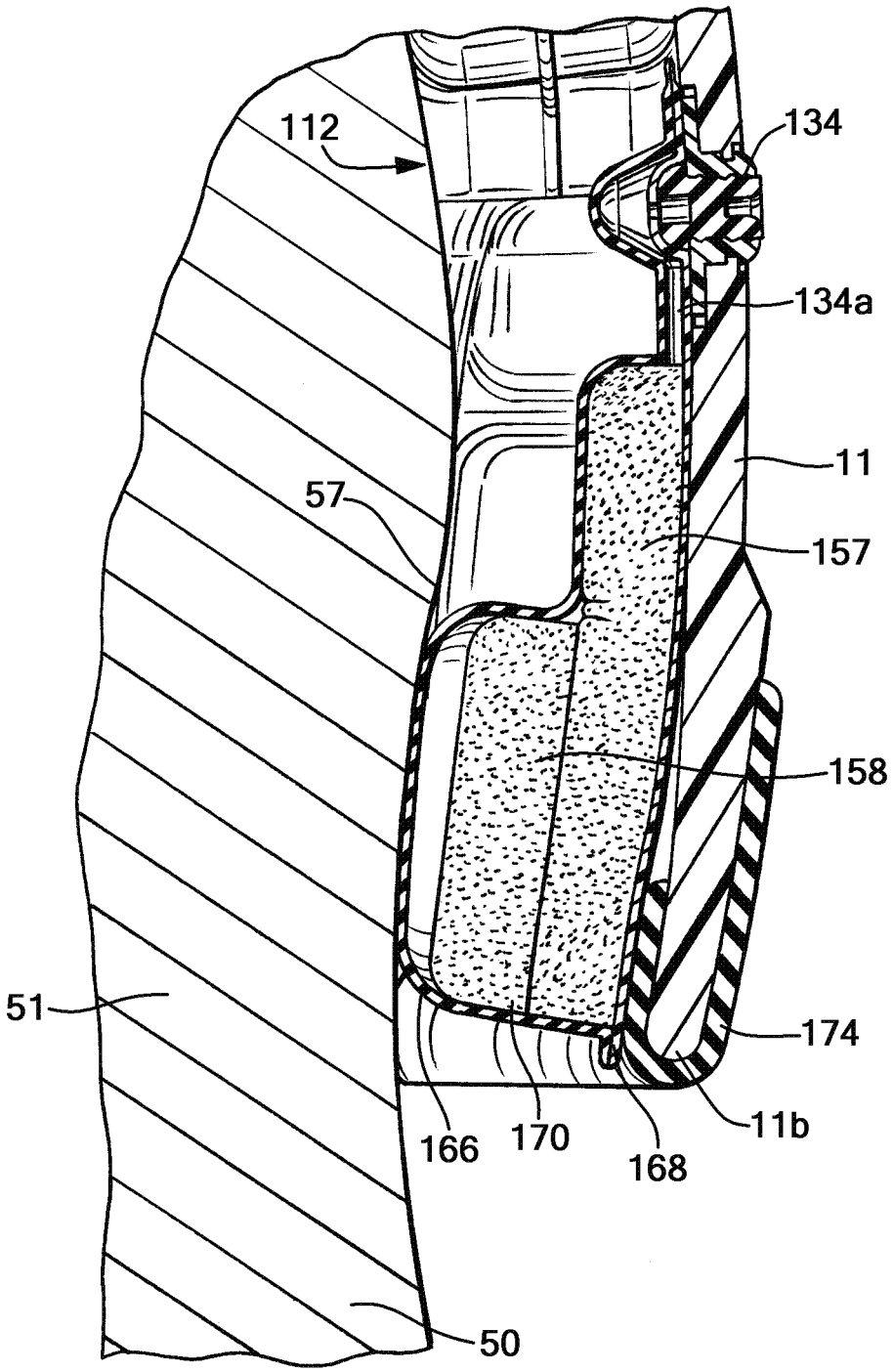

The occipital cradle pad assembly 114 includes a housing 164 for the pad elements 156-158 consisting of a first vinyl sheet 166 vacuum formed with a second vinyl sheet 168. Referring to FIGS. 22 and 23, a portion of the housing 164 that is in fluid communication with the valve 134, which is accessible from the rear region of the helmet shell, and air channel 134*a* is inflatable to allow for independent and customized engagement of the intermediate pad element or an occipital energy attenuation element 158*a* with the occipital protuberance 57. As shown, the central pad element 157 and the intermediate pad element 158 include at least one pad member 170, such as DER-TEX VN 600 PVC nitrile foam padding. In one embodiment, the central pad element 157 and the intermediate pad element 158 have a thickness ranging from 0.5 to 1.0 inch. Referring back to FIG. 21, the housing 164 includes peripheral sealed regions 172 adjacent the slot 156 *c* and the intermediate pad element 158. The lower extent of the sealed regions 172 *a, b*, the intermediate pads 158*a, b* and the peripheral pads 156*a, b* combine to define a lower edge of the occipital pad assembly 114 that is substantially adjacent the lower rear edge 11 *b* of the helmet shell 11. As shown in FIGS. 22 and 23, the lower rear edge 11*b* is received by a rear nameplate or bumper 174, wherein the occipital pad assembly 114 engages the rear bumper 174.

The first intermediate energy attenuation element 158*a* has an arrangement of five side walls, which includes a first side wall 330 having a first side wall edge 330*a*, a second side wall 331 having a second side wall edge 331*a*, a third side wall 332 having a third side wall edge 332*a*, a fourth side wall 333 having a fourth side wall edge 333*a*, and a fifth side wall 334 having a fifth side wall edge 334*a*. The arrangement of these side walls 330, 331, 332, 333 collectively define a first intermediate housing 165*a* of the first intermediate energy attenuation element 158*a*. The second intermediate energy attenuation element 158*b* also has an arrangement of five side walls, which includes a first side wall 336 having a first side wall edge 336*a*, a second side wall 337 having a second side wall edge 337*a*, a third side wall 338 having a third side wall edge 338*a*, a fourth side wall 339 having a fourth side wall edge 339*a*, and a fifth side wall 340 having a fifth side wall edge 340*a*. The arrangement of these side walls 336, 337, 338, 339 collectively define a second intermediate housing 165*b* of the second intermediate energy attenuation element 158*b*. The first, second, third, fourth, and fifth side walls 330-334, 336-340 of the first and second intermediate energy attenuation elements 158*a*, 158*b* are substantially planar, as shown in FIGS. 2B, and 21-23. The first side walls 330, 336 are arranged substantially perpendicular to the second and fourth side walls 331, 337, 333, 339. Also, an obtuse angle is formed between the second sides 331, 337 and the third sides 332, 338. Similarly, an obtuse angle is formed between the fourth sides 333, 339 and the fifth sides 334, 340.

As best shown in FIGS. 21, the central gap or occipital gap 158*c* is formed between an extent of the first side wall 330 of the first intermediate housing 165*a* and an extent of the first side wall 336 of the second intermediate housing 165*b*. Further, the configuration and the positional relationship causes: (i) the first side wall 330 of the first intermediate energy attenuation element 158*a* to be substantially parallel with the first side wall 336 of the second intermediate energy attenuation element 158*b*, (ii) the second side wall 331 of the first intermediate energy attenuation element 158*a* to be aligned with the second side wall 337 of the second intermediate energy attenuation element 158*b*, and (iii) the fourth side wall 333 of the first intermediate energy attenuation element 158*a* to be aligned with the fourth side wall 339 of the second intermediate energy attenuation element 158*b*.

While the specific embodiments have been illustrated and described, numerous modifications come to mind without significantly departing from the spirit of the invention, and the scope of protection is only limited by the scope of the accompanying Claims.

The invention claimed is:

1. An American football helmet comprising:

a helmet shell including a crown region and a rear region; and an energy attenuation assembly configured to be positioned within the helmet shell, the energy attenuation assembly including:

an inflation valve that is accessible through an aperture formed in the rear region of the helmet shell;

an occipital energy attenuation assembly in fluid communication with the inflation valve, the occipital energy attenuation assembly including:

a first intermediate energy attenuation element positioned in the rear region of the helmet shell, the first intermediate energy attenuation element having a first intermediate housing with a first side wall, a second side wall, and a third side wall, and wherein an obtuse angle is formed between said second and third side walls of the first intermediate housing;

a second intermediate energy attenuation element positioned in the rear region of the helmet shell, the second intermediate energy attenuation element having a second intermediate housing with a first side wall, a second side wall, and a third side wall, and wherein an obtuse angle is formed between said second and third side walls of the second intermediate housing; and, a first occipital gap formed between an extent of the second side wall of the first intermediate housing and an extent of the second side wall of the second intermediate housing; and a crown energy attenuation assembly configured to be positioned within the crown region of the helmet shell, the crown energy attenuation assembly including:

a first energy attenuation element having a first housing with a sidewall arrangement including at least a first side wall that extends from a second side wall;

a second energy attenuation element having a second housing with a sidewall arrangement including at least a first side wall that extends from a second side wall; and wherein the first and second energy attenuation elements are arranged to define a first crown gap between the first side wall of the first housing and the second side wall of the second housing.

2. The American football helmet of claim 1, wherein the first intermediate housing of the first intermediate energy attenuation element of the occipital energy attenuation assembly further comprises two additional sidewalls to provide five sidewalls that provides the first intermediate housing with a pentagonal configuration.

3. The American football helmet of claim 1, wherein the first side wall of the first intermediate housing is substantially parallel with the first side wall of the second intermediate housing, and the second side wall of the first intermediate housing is substantially aligned with the second side wall of the second intermediate housing.

4. The American football helmet of claim 1, wherein the first intermediate housing of the first intermediate energy attenuation element and the second intermediate housing of the second intermediate energy attenuation element both include a fourth side wall, and wherein the fourth side wall of the first intermediate housing is substantially aligned with the fourth side wall of the second intermediate housing.

5. The American football helmet of claim 1, wherein the first intermediate housing of the first intermediate energy attenuation element and the second intermediate housing of the second intermediate energy attenuation element both include a fourth side wall, and wherein the fourth side wall of the first intermediate housing is substantially parallel with the second side wall of the first intermediate housing, and the fourth side wall of the second intermediate housing is substantially parallel with the second side wall of the second intermediate housing.

6. The American football helmet of claim 1, wherein when the football helmet is worn by a player, a substantial extent of the occipital energy attenuation assembly is positioned below the player's occipital protuberance.

7. The American football helmet of claim 1, wherein the occipital energy attenuation assembly further includes a first peripheral pad element and a second peripheral pad element, and wherein the first peripheral pad element resides outward of the first intermediate energy attenuation element and the second peripheral pad element resides outward of the second intermediate energy attenuation element.

8. The American football helmet of claim 1, wherein the first housing of the first energy attenuation element of the crown energy attenuation assembly has six side walls that provide the first housing with a hexagonal configuration.

9. The American football helmet of claim 1, wherein the first side wall of the first housing of the first energy attenuation element of the crown energy attenuation assembly is substantially parallel with the second side wall of the second housing of the second energy attenuation element of the crown energy attenuation assembly.

10. The American football helmet of claim 1, wherein the first housing of the first energy attenuation element of the crown energy attenuation assembly includes an inner wall that: extends between said first and second side walls of the said first housing, and is adapted to make contact with a player's head when the football helmet is worn by said player.

11. The American football helmet of claim 10, wherein the crown energy attenuation assembly further comprises a distinct layer positioned between said inner wall of said first housing of the first energy attenuation element of the crown energy attenuation assembly and the shell.

12. The American football helmet of claim 11, further comprising an energy attenuation material positioned between said distinct layer and the helmet shell.

13. The American football helmet of claim 12, wherein said first energy attenuation element of the crown energy attenuation assembly includes a first material positioned within said first housing; and wherein said energy attenuation material that is positioned between the distinct layer and the helmet shell is formed from a second material that is different from said first material of the first energy attenuation element.

14. An American football helmet comprising:

a helmet shell including a rear region; and an occipital energy attenuation assembly removably installable in the helmet shell, the occipital energy attenuation assembly including:

a first intermediate energy attenuation element positioned in the rear region of the helmet shell, the first intermediate energy attenuation element having a first intermediate housing with: (i) a first side wall, (ii) a second side wall extending from the first side wall, (iii) a third side wall extending from the second side wall, (iv) a fourth side wall extending from the third side wall, and (v) a fifth side wall extending from the fourth side wall, wherein the second and fifth side walls are substantially parallel to each other, and wherein an obtuse angle is formed between the second and third side walls;

a second intermediate energy attenuation element positioned in the rear region of the helmet shell, the second intermediate energy attenuation element having a second intermediate housing with: (i) a first side wall, (ii) a second side wall extending from the first side wall, and (iii) a third side wall extending from the second side wall; and, a first occipital gap formed between an extent of the first side wall of the first intermediate housing of the first intermediate energy attenuation element and an extent of the first side wall of the second intermediate housing of the second intermediate energy attenuation element.

15. The American football helmet of claim 14, wherein when the first and second intermediate energy attenuation elements are in an uninstalled state: the first side wall of the first intermediate housing is parallel with the first side wall of the second intermediate housing, and the second side wall of the first intermediate housing is collinear with the second side wall of the second intermediate housing.

16. The American football helmet of claim 14, wherein when the first and second intermediate energy attenuation elements are in an uninstalled state: an obtuse angle is formed between the second and third side walls of the first intermediate housing of the first intermediate energy attenuation element, and an obtuse angle is formed between the second and third side walls of the second intermediate housing of the second intermediate energy attenuation element.

17. The American football helmet of claim 14, wherein the occipital energy attenuation assembly further includes an inflation valve that is in fluid communication with at least the first intermediate energy attenuation element.

18. The American football helmet of claim 14, wherein an approximately 90 degree angle is formed between the first and second side walls of the first intermediate housing of the first intermediate energy attenuation element.

19. The American football helmet of claim 14, wherein the first intermediate housing of the first intermediate energy attenuation element and the second intermediate housing of the second intermediate energy attenuation element have a pentagonal configuration.

20. The American football helmet of claim 14, wherein the second intermediate housing of the second intermediate energy attenuation element includes (iv) a fourth side wall extending from the third side wall, and (v) a fifth side wall extending from the fourth side wall, wherein the second and fifth side walls are substantially parallel to each other, and wherein an obtuse angle is formed between the second and third side walls.

21. The American football helmet of claim 20, wherein the first side wall of the first intermediate housing is substantially parallel with the first side wall of the second intermediate housing.

22. The American football helmet of claim 14, wherein when the football helmet is worn by a player, a substantial extent of the occipital energy attenuation assembly is positioned below the player's occipital protuberance.

23. The American football helmet of claim 14, wherein the occipital energy attenuation assembly further includes a first peripheral pad element and a second peripheral pad element, and wherein both the first peripheral pad element resides outward of the first intermediate energy attenuation element and the second peripheral pad element resides outward of the second intermediate energy attenuation element.

24. The American football helmet of claim 14, further comprising a crown energy attenuation assembly configured to be positioned within a crown region of the helmet shell, the crown energy attenuation assembly including:

a first energy attenuation element having a first housing with a first side wall and a second side wall, wherein said first side wall of the first housing of the first energy attenuation element extends from the second side wall of said first housing and an obtuse angle is formed between said first and second side walls of said first housing when the crown energy attenuation assembly is in an uninstalled state; and, a second energy attenuation element having a second housing with a first side wall and a second side wall, wherein said first side wall of the second housing of the second energy attenuation element extends from said second side wall of said second housing and an obtuse angle is formed between said first and second side walls of said second housing when the crown energy attenuation assembly is in the uninstalled state.

25. The American football helmet of claim 24, wherein the first housing of the first energy attenuation element of the crown energy attenuation assembly has six side walls that provides the first housing with a hexagonal configuration.

26. The American football helmet of claim 24, wherein the first and second energy attenuation elements of the crown energy attenuation assembly are arranged to define a first crown gap between the first side wall of the first housing of the first energy attenuation element of the crown energy attenuation assembly and the second side wall of the second housing of the second energy attenuation element of the crown energy attenuation assembly.

27. The American football helmet of claim 24, wherein the first side wall of the first housing of the first energy attenuation element is substantially parallel with the second side wall of the second housing of the second energy attenuation element.

28. The American football helmet of claim 24, wherein the first housing of the first energy attenuation element includes an inner wall that: extends between said first and second side walls of the first housing, and is adapted to make contact with a player's head when the football helmet is worn by said player.

29. The American football helmet of claim 28, wherein the crown energy attenuation assembly further comprises a distinct layer positioned between said inner wall of said first housing and the shell.

30. The American football helmet of claim 29, further comprising an energy attenuation material positioned between said distinct layer and the helmet shell.

31. The American football helmet of claim 24, wherein the first energy attenuation element of the crown energy attenuation assembly and the second energy attenuation element of the crown energy attenuation assembly are in an interconnected yet discontinuous positional relationship as provided by an intervening connection segment.

32. The American football helmet of claim 31, wherein due to the interconnected yet discontinuous positional relationship, said first energy attenuation element and said second energy attenuation element are adapted to behave independently in response to an impact force applied to the helmet shell.

33. The American football helmet of claim 32, wherein due to said independent behavior, the response of the first energy attenuation element does not influence the response of the second energy attenuation element from the impact force applied to the helmet shell.

34. The American football helmet of claim 14, wherein the first intermediate energy attenuation element of the occipital energy attenuation assembly includes a comfort pad material located within the first intermediate housing, wherein the comfort pad material is adapted to behave differently than an energy attenuating pad material in response to an impact applied to the helmet shell.

35. The American football helmet of claim 34, wherein the energy attenuating pad material is adapted to provide at least approximately a 25% compression deflection under 8 pounds per square inch of load under the ASTM D-1056 Standard.

* * * * *